US009752391B2

(12) United States Patent
Jekot et al.

(10) Patent No.: US 9,752,391 B2
(45) Date of Patent: Sep. 5, 2017

(54) VARIABLE GUIDE AND PROTECTION BUSHING FOR WELL CONVEYANCE

(71) Applicant: ONESUBSEA IP UK LIMITED, London (GB)

(72) Inventors: Michael Vincent Jekot, Austin, TX (US); David H. Theiss, Tomball, TX (US); Jack H. Vincent, Katy, TX (US); Stephen E. Gaydos, Jersey Village, TX (US); Nguyen D. Trinh, Houston, TX (US); Casey B. Hahn, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/825,090

(22) Filed: Aug. 12, 2015

(65) Prior Publication Data

US 2016/0047183 A1 Feb. 18, 2016

Related U.S. Application Data

(60) Provisional application No. 62/036,500, filed on Aug. 12, 2014.

(51) Int. Cl.
*E21B 17/10* (2006.01)

(52) U.S. Cl.
CPC ..... *E21B 17/1007* (2013.01)

(58) Field of Classification Search
CPC ..... E21B 17/1007; E21B 17/1014; E21B 17/1042; E21B 17/1057
(Continued)

(56) References Cited

U.S. PATENT DOCUMENTS 3,124,196 A 3/1964 Solum
4,318,547 A * 3/1982 Ericson ..... F16L 25/14 277/607
(Continued)

FOREIGN PATENT DOCUMENTS

DE 19904016839 C2 5/1994
GB 2234772 A 2/1991

OTHER PUBLICATIONS

International Patent Application No. PCT/US2015/044909 International Search Report and Written Opinion dated Nov. 6, 2015 (18 pages).

*Primary Examiner* — Matthew R Buck
(74) *Attorney, Agent, or Firm* — Conley Rose, P.C.

(57) ABSTRACT

A guide and protection bushing assembly is mountable in a well production system (e.g., a subsea tree) having an intervention member (e.g., a blowout preventer). The assembly guides a string of components to a cable hanger sealing surface disposed in the production system without damaging the sealing surface. The assembly includes a body having a first end engaging an intervention member, a second end engaging the production system, an outer surface, and an inner through passage that expands radially at the first end to form a funnel shape. In some embodiments, the assembly may further include rollers, leaf springs, or a protective sleeve coupled to biasing members, a plurality of centering disks having a plurality of flexible flaps separated by spacers, and/or centering devices with fins separated by spacers. In some embodiments, the assembly may further include a hydraulically actuated plurality of rams, a piston with a plurality of protective elements, a plurality of nozzle jets, and/or a plurality of bladders.

20 Claims, 23 Drawing Sheets

(58) Field of Classification Search
USPC ..... 166/379
See application file for complete search history.

(56) References Cited

U.S. PATENT DOCUMENTS

| | | | | |
|---|---|---|---|---|
| 4,651,823 | A | 3/1987 | Spikes | |
| 4,744,730 | A | 5/1988 | Roeder | |
| 4,862,990 | A | 9/1989 | Cole | |
| 5,109,923 | A * | 5/1992 | Koleilat | E21B 33/04 166/117 |
| 5,360,063 | A * | 11/1994 | Henderson, Jr. | E21B 17/1007 166/208 |
| 5,746,582 | A | 5/1998 | Patterson | |
| 6,003,602 | A * | 12/1999 | Wilkins | E21B 33/035 166/339 |
| 6,302,201 | B1 * | 10/2001 | Elliott | E21B 17/1007 15/104.05 |
| 6,394,186 | B1 * | 5/2002 | Whitelaw | E21B 12/04 166/241.1 |
| 6,516,861 | B2 * | 2/2003 | Allen | E21B 17/1007 166/351 |
| 6,761,232 | B2 | 7/2004 | Moody et al. | |
| 6,966,381 | B2 * | 11/2005 | Stjernstrom | E21B 33/035 166/250.08 |
| 7,121,349 | B2 * | 10/2006 | Jennings | E21B 19/24 166/241.1 |
| 7,467,663 | B2 * | 12/2008 | Reimert | E21B 33/035 166/344 |
| 8,322,441 | B2 * | 12/2012 | Fenton | E21B 17/1007 166/339 |
| 8,443,898 | B1 * | 5/2013 | McClinton | E21B 17/1007 166/337 |
| 9,206,663 | B2 * | 12/2015 | Smith | E21B 33/043 |
| 9,222,316 | B2 * | 12/2015 | Christie | E21B 43/00 |
| 2003/0012473 | A1 | 1/2003 | Lutz et al. | |
| 2003/0192698 | A1 * | 10/2003 | Dallas | E21B 33/068 166/307 |
| 2012/0261132 | A1 * | 10/2012 | Wilson | E21B 47/0915 166/348 |
| 2013/0175044 | A1 * | 7/2013 | Telfer | E21B 17/1007 166/358 |

* cited by examiner

VARIABLE GUIDE AND PROTECTION BUSHING FOR WELL CONVEYANCE

CROSS-REFERENCE TO RELATED APPLICATIONS

This application claims the benefit of U.S. Provisional Application No. 62/036,500 filed Aug. 12, 2014, and entitled "Variable Guide and Protection Bushing for Well Conveyance," which is incorporated herein by reference in its entirety for all purposes.

STATEMENT REGARDING FEDERALLY SPONSORED RESEARCH OR DEVELOPMENT

Not applicable.

BACKGROUND

Throughout the life cycle of a well there are multiple instances when components need to be conveyed in and out of the well. Electric submersible pumps (ESPs) are an example of one of these components.

Conventional ESPs are attached to the tubing string and deployed downhole. ESPs fail frequently and require replacement. To replace a traditionally deployed ESP, the entire tubing string must be retrieved from the wellbore, which is time consuming, incurs intervention costs, and carries risk. An alternatively deployed ESP, instead, hangs within the tubing string by a cable hanger in the well production system. When an alternatively deployed ESP fails, the ESP string can be replaced independently from the tubing string.

When deploying or retrieving alternatively deployed ESPs, it is important to protect the cable hanger sealing surface in the well production system; scratches to the cable hanger sealing surface could compromise the integrity of its primary production barrier. Further, a standard bore protector cannot typically be used with an alternatively deployed ESP because it would interfere with landing the cable hanger in its designated location or profile. Further, the ESP might be suspended from a flexible member and may be unpredictably in contact with any side or portion of the wellbore. In addition, the inner diameter of the bore the ESP must travel through to reach the cable hanger lock profile transitions from a larger bore to a smaller bore. The ESP must make the transition from larger to smaller diameter bore without getting hung up, damaging the ESP string, or damaging the well production system.

SUMMARY

In an embodiment, a guide and protection bushing assembly is mountable in a well production system (e.g., a subsea tree) having an intervention member (e.g., a blowout preventer and/or a lower riser package) installed thereon. The assembly is for guiding a string of components to a cable hanger sealing surface disposed in the well production system. The assembly includes a body having a central axis, a first end, a second end, an outer surface, and an inner through passage. Moreover, the outer surface at the first end is configured to engage the intervention member, and the outer surface at the second end is configured to engage the production system. In addition, the inner through passage expands radially at the first end to form a funnel shape.

In an embodiment, a method of guiding a string of components to a cable hanger sealing surface disposed in a well production system may include installing a guide and protection bushing assembly therein. The assembly includes a body having a central axis, a first end, a second end, an outer surface, and an inner through passage that expands radially at the first end to form a funnel shape. The method of guiding the string of components to the cable hanger sealing surface further includes engaging an intervention member with the outer surface at the first end and engaging the production system with the outer surface at the second end. Moreover, the method includes passing components of the string into the inner through passage, and centralizing the components of the string.

The foregoing has outlined rather broadly the features of the disclosure such that the detailed description of the disclosure that follows may be better understood. The various characteristics described above, as well as other features, will be readily apparent to those skilled in the art upon reading the following detailed description, and by referring to the accompanying drawings. It should be appreciated by those skilled in the art that the specific features of the disclosed embodiments can be combined or re-arranged as necessary for desired results. It should also be appreciated by those skilled in the art that the conception and the specific embodiments disclosed may be readily utilized as a basis for modifying or designing other structures for carrying out the same purposes of the disclosure. It should further be realized by those skilled in the art that such equivalent constructions do not depart from the spirit and scope of the disclosure as set forth in the appended claims.

BRIEF DESCRIPTION OF THE DRAWINGS

For a detailed description of the preferred embodiment of the disclosure, reference will now be made to the accompanying drawings in which.

DETAILED DESCRIPTION

Figure 1:
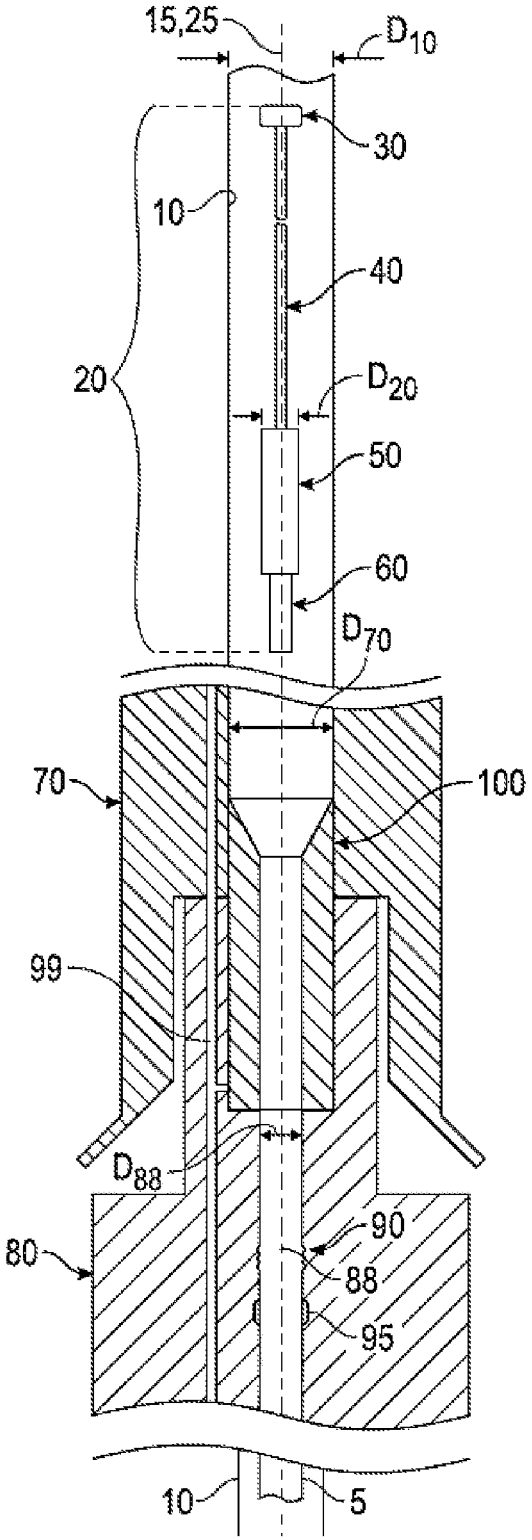
FIG. 1 is a partial cross sectional view of a portion of a well production system and a variable guide and protection bushing system in accordance with the principles described herein for guiding an ESP string while protecting a cable hanger lock profile.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosures, including the claims, is limited to that embodiment.

Certain terms are used throughout the following description and claim to refer to particular system components. This document does not intend to distinguish between components that differ in name but not function. Moreover, the drawing figures are not necessarily to scale. Certain features of the disclosure may be shown exaggerated in scale or in somewhat schematic form, and some details of conventional elements may not be shown in the interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Still further, reference to "up" or "down" may be made for purposes of description with "up," "upper," "upward," or "above" meaning generally toward or closer to the surface of the earth, and with "down," "lower," "downward," or "below" meaning generally away or further from the surface of the earth.

The disclosure describes a device that guides a string of components into a wellbore. The device can be a separate component that interfaces with any number of production systems or members (e.g., tree, tubing hanger, adaptor spool, tubing head spool, wellhead, etc.), intervention equipment or members (e.g., blowout preventer (BOP), lightweight intervention (LWI), etc.), and installation equipment or integral within said items. Guidance is provided, directly or indirectly, within the internal bore of the device to the string of components passing through it. Guidance can be actively provided through a supporting function on any of the production members, intervention equipment, or installation equipment, or can be passive in nature such that in conveying the string through the device, the string will encounter guidance features. The string can be comprised of various components with different lengths, shapes, diameters, weights, and/or rigidity, or can be comprised of one continuous or integral geometry. The device can protect critical surfaces within a production member indirectly through guidance (i.e., centralization) or directly by providing a material member between the string of components and the critical surface.

Referring now to FIG. 1, an electric submersible pump (ESP) string 20 is lowered downhole, into a well 10 having a central axis 15, passing through an intervention member 70 such as without limitation a BOP and/or a lower riser package (LRP), a guide and protection bushing (GPB) assembly 100, and a production system 80 to mate with a cable hanger lock profile 90 disposed in the production system 80. Any suitable intervention equipment known in the art may be used, and a BOP is described in this disclosure for illustrative purposes. Likewise, any suitable production system or member known in the art may be used, and a tree is described in this disclosure for illustrative purposes. Further, the ESP string 20 may instead be other tool strings. The intervention member 70, GPB assembly 100, and production system 80 each have a central axis coaxial with wellbore central axis 15. In an embodiment, an annular bore or hydraulic control line 99 may extend through at least a portion of the intervention member 70 and/or the production system 80; and the GPB system 100 may be hydraulically connected to the annular bore 99. The ESP string 20 has a central axis 25 and comprises a plurality of components disposed in series; the components include a cable hanger 30 from which an ESP cable 40, an ESP 50, and a stinger 60 may be suspended. In the embodiments disclosed herein, the ESP 50 is alternatively deployed, meaning it is suspended within the production tubing 5 by a cable hanger and conveyed into the well 10; the ESP 50 further may be configured for subsea use.

The components of the ESP string 20 have varying outside diameters. The ESP string central axis 25 is shown coaxial with well central axis 15; however, the component of the ESP string 20 having the largest outer diameter $D_{20}$ has a diameter $D_{20}$ that is less than the inner diameter $D_{10}$ of the well 10, and may move radially within well 10 while being lowered into the well 10. The cable hanger 30 has the largest outer diameter of the ESP string.

Figure 2:
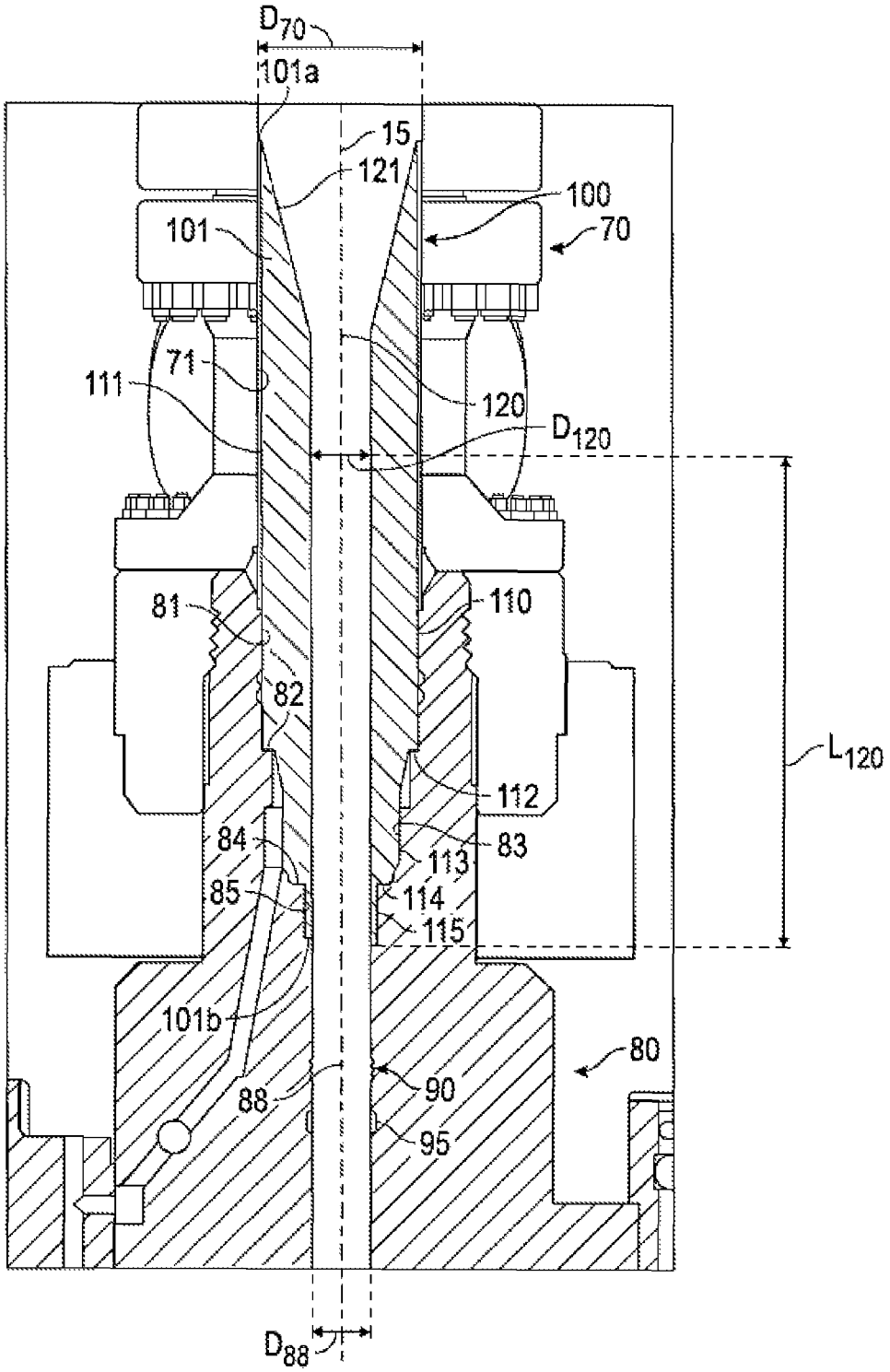
FIG. 2 is a partial cross sectional view of a first embodiment of the system of FIG. 1.

During installation, the ESP string 20 transitions from the intervention member 70 having a larger inner diameter $D_{70}$ to a bore 88 in the production system 80 having a smaller inner diameter $D_{88}$. The cable hanger 30 connects to the cable hanger lock profile 90 and seals to a sealing surface 95, as shown in FIG. 1. Referring now to FIG. 2, in a first embodiment, the GPB assembly 100 comprises a body 101 having an upper end 101*a*, a lower end 101*b*, an outer surface 110, and an inner through passage 120. The outer surface 110 may include an outer cylindrical surface 111, a first downward-facing shoulder 112, a first reduced diameter portion 113, a second downward-facing shoulder 114, and a second reduced diameter portion 115. The GPB body lower end 101*b* is installed in the top of the production system 80 such that a lower portion of the outer cylindrical surface 111 engages at least a portion of an inner cylindrical surface 81 of the production system 80, the first downward-facing shoulder 112 engages a first upward-facing shoulder 82 of the production system 80, the first reduced diameter portion 113 engages a first enlarged diameter portion 83 of the production system 80, the second downward-facing shoulder 114 engages a second upward-facing shoulder 84 of the production system 80, and the second reduced diameter portion 115 engages a second enlarged diameter portion 85 of the production system 80. Reduced and enlarged diameter portions may be cylindrical, tapered, or any other shape, wherein the reduced or enlarged diameter may be an average diameter and sized relative to another portion as described.

In the present embodiment, the GPB body 101 extends upward into the intervention member 70 such that an upper portion of the outer cylindrical surface 111 is proximate to an inner cylindrical surface 71 of the intervention member 70. Other embodiments may comprise varying geometries.

The inner through passage 120 may be cylindrical and extends upward from the lower end 101*b* to a sloped diameter portion 121. The sloped diameter portion 121 expands radially outward and upward toward upper end 101*a* to form a frustoconical or funnel shape. The GPB inner through passage 120 has an inner diameter $D_{120}$ that is substantially equivalent to the inner diameter $D_{88}$ of production system passage 88.

Though shown in the present embodiment with the GPB 100 extending up into the intervention member 70, in other embodiments the GPB 100 may be seated entirely in the production system 80 and not extend into the intervention member 70. The GPB 100 may be installed in the production system 80 by any suitable manner known in the art including, but not limited to, being dropped in or landed, snapped in, or locked down to the top of the production system 80. The GPB 100 may be fastened to the production system 80 by any suitable means known in the art including, but not limited to, a snap ring, hydraulically or spring actuated dogs, a detent ring, and a detent pin.

During operation, as the ESP string 20 (shown in FIG. 1) is lowered into the well 10, the sloped diameter portion 121 of the GPB upper end 101*a* guides the components of the ESP string 20 toward the center of through passage 120. Once the ESP string 20 is lowered into the GPB 100, the length $L_{120}$ and diameter $D_{120}$ of the GPB 100 center the components of the ESP string 20 in the inner through passage 120 and subsequently in the bore 88. Keeping the ESP string 20 centered prevents the ESP string 20 from contacting the sealing surface 95 as the ESP string passes through the cable hanger lock profile 90, thus reducing the risk of damage to the sealing surface 95. Preventing damage to the sealing surface 95 minimizes scratches on the sealing surface which would potentially compromise the integrity of the seal. The GPB 100, thus, provides a smooth transition from the larger bore diameter $D_{70}$ of the intervention member 70 to the smaller bore diameter $D_{88}$ of the production system 80, and protects the sealing surface 95 from damage by preventing contact between the ESP string 20 components and the sealing surface 95.

Figure 3:
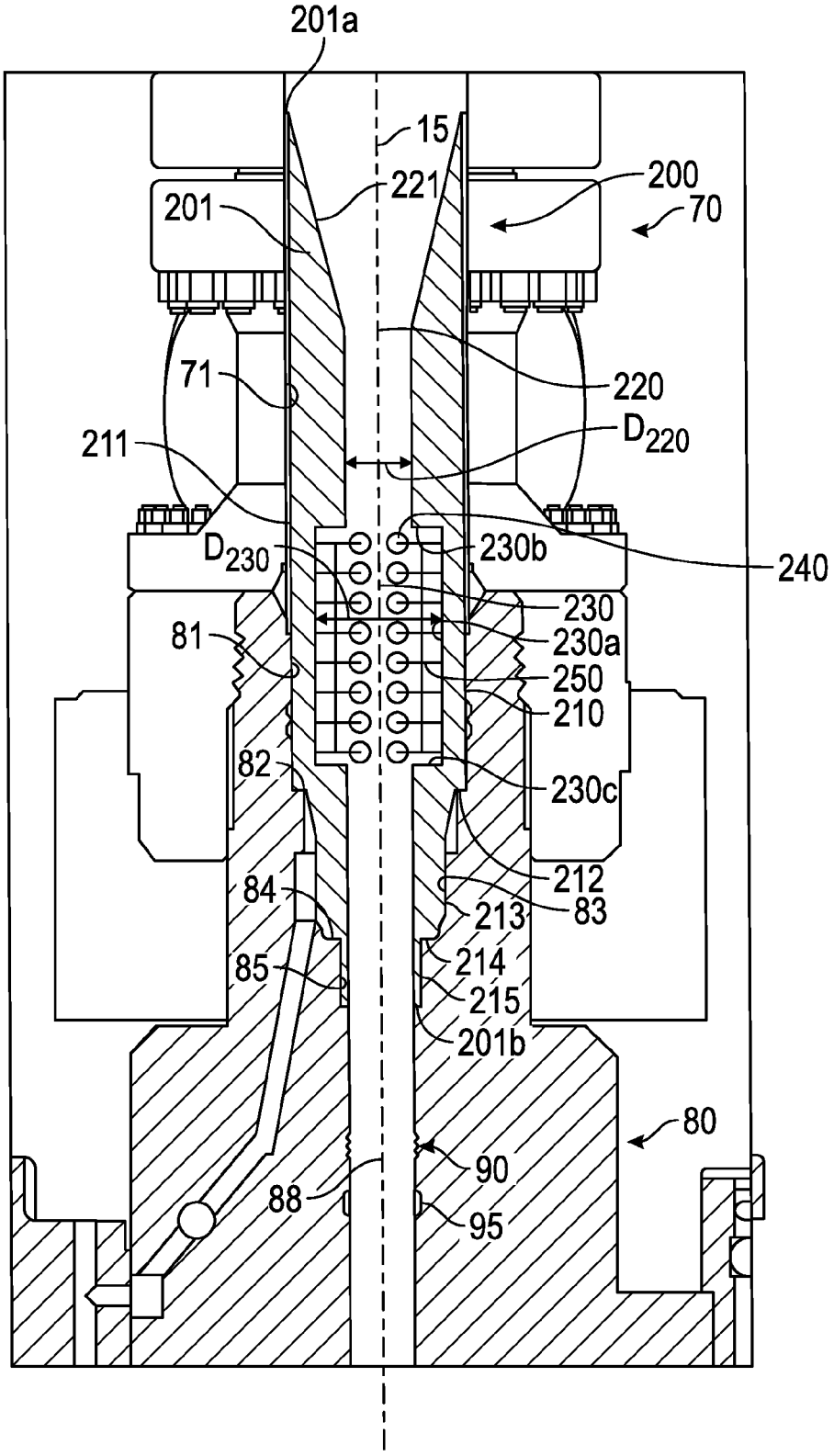
FIG. 3 is a partial cross sectional view of a second embodiment of the system of FIG. 1.

Referring now to FIG. 3, in a second embodiment, the GPB assembly 200 comprises a body 201 having an upper end 201*a*, a lower end 201*b*, an outer surface 210, and an inner through passage 220. The body upper end 201*a*, lower end 201*b*, and outer surface 210 are similar to those of body 101 shown in the first embodiment; like parts are designated with like or similar reference numerals. In the present embodiment, the inner through passage 220 comprises a coaxial cylindrical cutout 230 having a cylindrical surface 230*a*, an upper shoulder 230*b*, and a lower shoulder 230*c*. The inner diameter $D_{230}$ of the cylindrical surface 230*a* is larger than the inner diameter $D_{220}$ of the through passage 220.

Body 201 further comprises a plurality of rollers 240 circumferentially disposed about central axis 15. In the present embodiment, the rollers 240 are disposed in eight rows with each row having four rollers. However, in alternative embodiments, the rollers 240 in one row may be staggered from the rollers 240 in the row above and below such that a roller in one row is not immediately above or below a roller in the next row. In other embodiments, fewer or more than eight rows of rollers 240 may be used; in addition, the number of rollers per row may be varied. In another embodiment, there may be two rows of rollers 240 that are spaced apart or separated by a large gap. The rollers 240 may be made of any suitable material known in the art including, but not limited to, polymers, rubber, and soft metals.

Referring still to FIG. 3, each roller 240 is coupled to a biasing member 250 and each biasing member is coupled to the cylindrical surface 230*a*. The biasing members 250 are further connected to one another and configured such that movement of one roller 240 is transferred to the adjacent rollers causing the rollers 240 to act as one unit. The biasing members 250 may be any type of suitable biasing member known in the art including, but not limited to, helical springs, wave springs, elastomeric springs, and leaf springs.

In operation, as the ESP string 20 (shown in FIG. 1) is lowered into the well 10, the sloped diameter portion 221 of the GPB upper end 201*a* guides the components of the ESP string 20 toward the center of through passage 220. The components of the ESP string 20 will successively engage the rollers 240, and as each component of the ESP string 20, which have varying diameters, reaches each row of rollers 240, the component exerts a force on the rollers and causes the corresponding biasing elements 250 to uniformly retract toward cylindrical surface 230*a*. As each ESP string 20 component passes a row of rollers 240, the biasing members 250 disengage and uniformly extend back toward central axis 15. The biasing elements 250 cause the rollers 240 to maintain contact with each ESP string 20 component while allowing the GPB 200 to accommodate and centralize each ESP string 20 component regardless of diameter. The GPB 200 thus acts as a variable centralizer to keep each ESP string 20 component centered in the inner through passage 220 and subsequently in the bore 88. Keeping the ESP string 20 centered prevents the ESP string 20 from contacting the sealing surface 95 as the ESP string passes through the cable hanger lock profile 90, thus reducing the risk of damage to the sealing surface 95.

Figure 4:
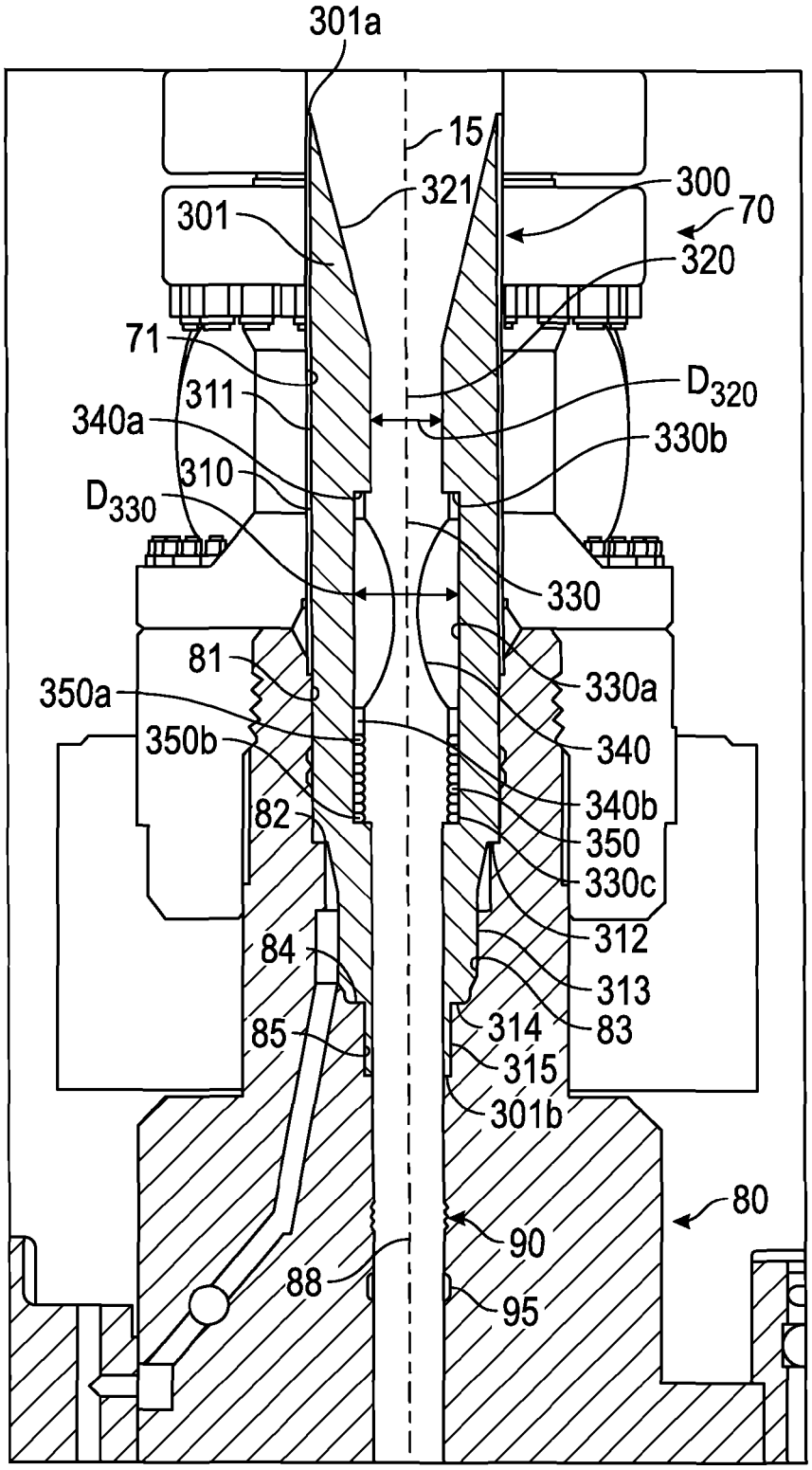
FIG. 4 is a partial cross sectional view of a third embodiment of the system of FIG. 1.

Referring now to FIG. 4, in a third embodiment, the GPB assembly 300 comprises a body 301 having an upper end 301*a*, a lower end 301*b*, an outer surface 310, and an inner through passage 320. The body upper end 301*a*, lower end 301*b*, and outer surface 310 are similar to those of body 101 shown in the first embodiment; like parts are designated with like or similar reference numerals. In the present embodiment, the inner through passage 320 comprises a coaxial cylindrical cutout 330 having a cylindrical surface 330*a*, an upper shoulder 330*b*, and a lower shoulder 330*c*. The inner diameter $D_{330}$ of the cylindrical surface 330*a* is larger than the inner diameter $D_{320}$ of the through passage 320.

Body 301 further comprises a plurality of leaf springs 340 circumferentially disposed about central axis 15. In the present embodiment, four leaf springs 340 (only two shown in cross section), each having a first or upper end 340*a* and a second or lower end 340*b*, are coupled to the upper shoulder 330*b* of cutout 330 at first end 340*a*, and coupled to a biasing member or spring 350 at second end 340*b*. Biasing member or spring 350 has a first or upper end 350*a* and a second or lower end 350*b* with the spring first end 350*a* being coupled to the leaf spring second or lower end 340*b*, and the spring second end 350*b* being coupled to the lower shoulder 330*c* of cutout 330. In other embodiments, varying numbers of leaf springs may be used. In further embodiments, the leaf springs 340 and biasing member 350 may be coupled in reverse order such that each leaf spring first end is coupled to the biasing member 350 and each leaf spring second end 340*b* is coupled to the lower shoulder 330*c*. The leaf springs 340 may be coated or include pads comprising a soft or smooth material such as a polymer or rubber to prevent the leaf springs 340 from damaging the ESP string 20 (shown in FIG. 1) as it passes through the GPB 300. In another embodiment, rollers similar to those described in the second embodiment may be coupled to the leaf springs to prevent damage to the ESP string 20. The biasing element 350 may be any type of suitable spring known in the art including, but not limited to, a helical spring, an elastomeric spring, and a wave spring.

In operation, as the ESP string 20 is lowered into the well 10, the sloped diameter portion 321 of the GPB upper end 301*a* guides the components of the ESP string 20 toward the center of through passage 320. The components of the ESP string 20 will engage the leaf springs 340, and as each component of the ESP string 20, which have varying diameters, reaches the leaf springs 340, the component exerts a force on the leaf springs 340 and causes the leaf springs to move radially outward toward cylindrical surface 330*a*, which in turn causes the biasing member 350 to compress axially toward lower shoulder 330*c*. As each ESP string 20 component passes the leaf springs 340, the leaf springs 340 move radially inward to the central axis 15 back to the unactuated position, which in turn causes the biasing member 350 to also move axially toward upper shoulder 330*b* or back to the unactuated position. The axial movement of the biasing member 350 allows the leaf springs 340 to move axially and maintain contact with each ESP string 20 component while allowing the GPB 300 to accommodate and centralize each ESP string 20 component regardless of diameter. The GPB 300, thus, acts as a variable centralizer to keep each ESP string 20 component centered in the inner through passage 320 and subsequently in the bore 88. Keeping the ESP string 20 centered prevents the ESP string 20 from contacting the sealing surface 95 as the ESP passes through the cable hanger lock profile 90, thus reducing the risk of damage to the sealing surface 95.

Referring now to FIGS. 5, 6A, 6B, 7A, and 7B, in a fourth embodiment, the GPB assembly 400 comprises a body 401 having an upper end 401*a*, a lower end 401*b*, an outer surface 410, and an inner through passage 420. The body upper end 401*a*, lower end 401*b*, and outer surface 410 are similar to those of body 101 shown in the first embodiment; like parts are designated with like or similar reference numerals. In the present embodiment, the inner through passage 420 comprises a plurality of circumferentially disposed radially extending cylindrical bores or chambers 430 having a back surface 430*a* and a cylindrical surface 430*b*.

Body 401 further includes a plurality of rams 440 circumferentially disposed about central axis 15, each ram 440 being disposed in one of the bores or chambers 430. The present embodiment includes six rams 440 (see FIGS. 6B and 7B) disposed in six corresponding chambers 430, each having a first end 440*a* opposite a second end 440*b*, and a surface 440*c*. The ram first end 440*a* may be coupled to at least one biasing member 450, wherein the biasing member 450 is biased in a retracted position toward back surface 430*a*. Each ram 440 may also include an annular groove 440*d* or cutout disposed in cylindrical surface 440*c* proximate to first end 440*a*. A seal 445 may be disposed in each groove 440*d*. A seal 435 may be disposed between the outer surface 410 of GPB assembly 400 and the inner cylindrical surface 81 of the production system 80 to allow pressurization from an annulus line 89 therein. In this and in other embodiments, additional or alternative seals may be disposed in other locations not shown or described. The annulus line 89 is in fluid communication with a flow passage 465 in the GPB 400. In embodiments, annulus line 89 may be annular bore 99 (shown in FIG. 1) and/or a hydraulic line.

In the present embodiment, the rams 440 and corresponding chambers 430 are cylindrical; in other embodiments, the rams 440 and corresponding chambers 430 may comprise geometries other than cylindrical; further, in place of rams, hydraulic actuators may be used. The rams 440 may be made of any suitable material known in the art including, but not limited to, metals and hard rubber. In other embodiments, preferably between four and six rams 440 are used.

Figure 5:
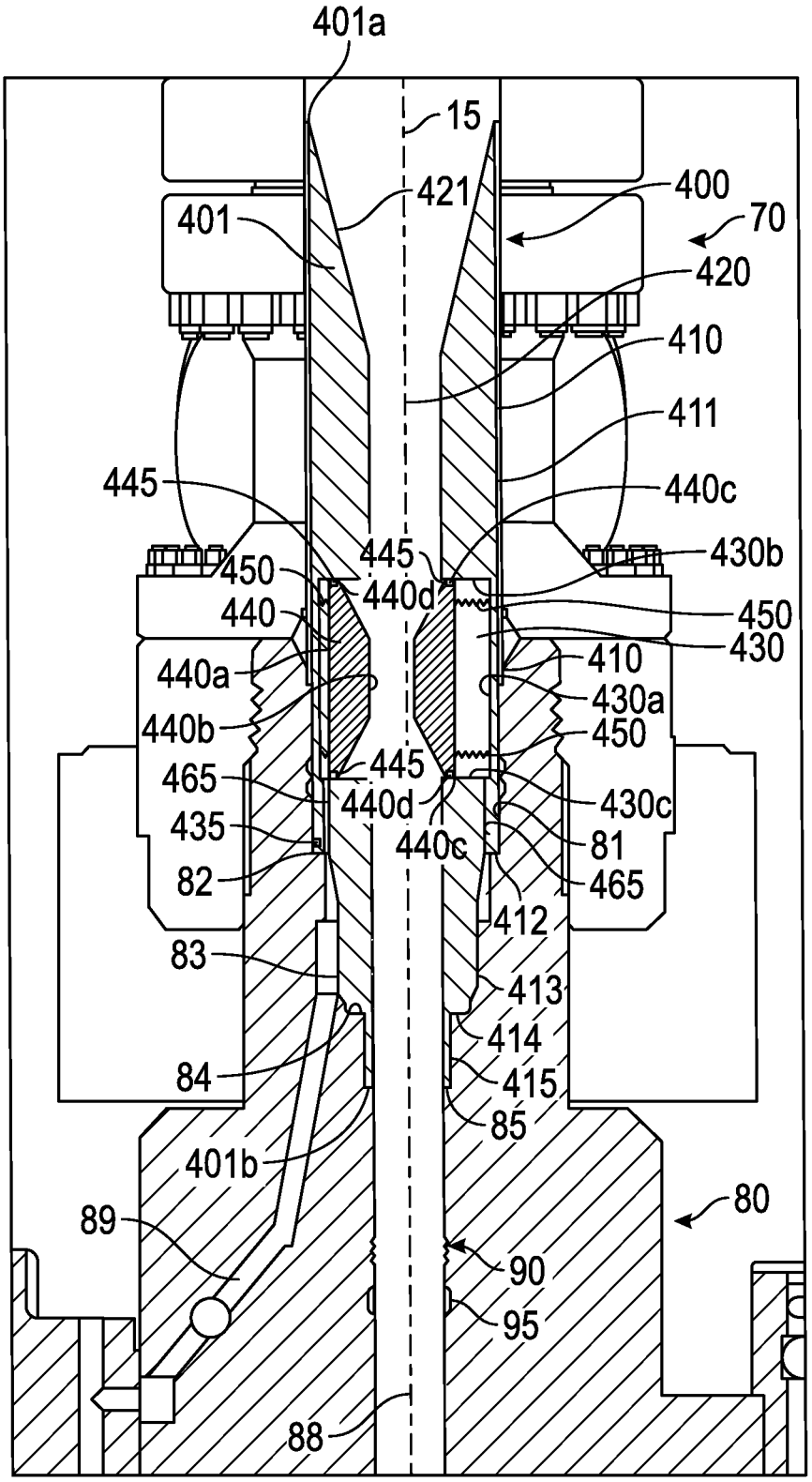
FIG. 5 is a partial cross sectional view of a fourth embodiment of the system of FIG. 1.
Figure 6A:
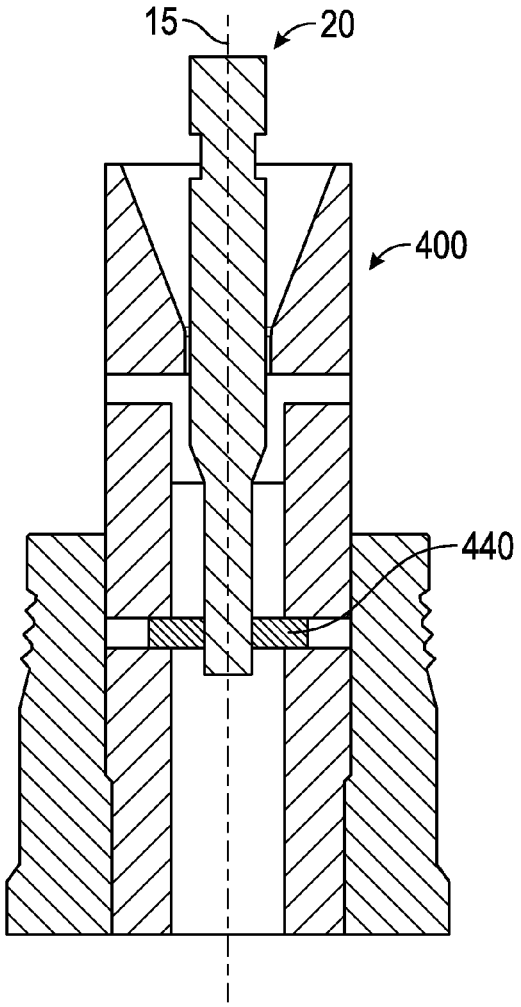
FIGS. 6A-6B are schematic cross sectional views of the fourth embodiment of the system of FIG. 5.
Figure 6B:
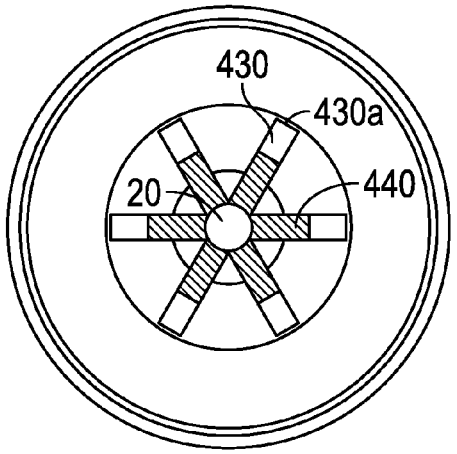
Figure 7A:
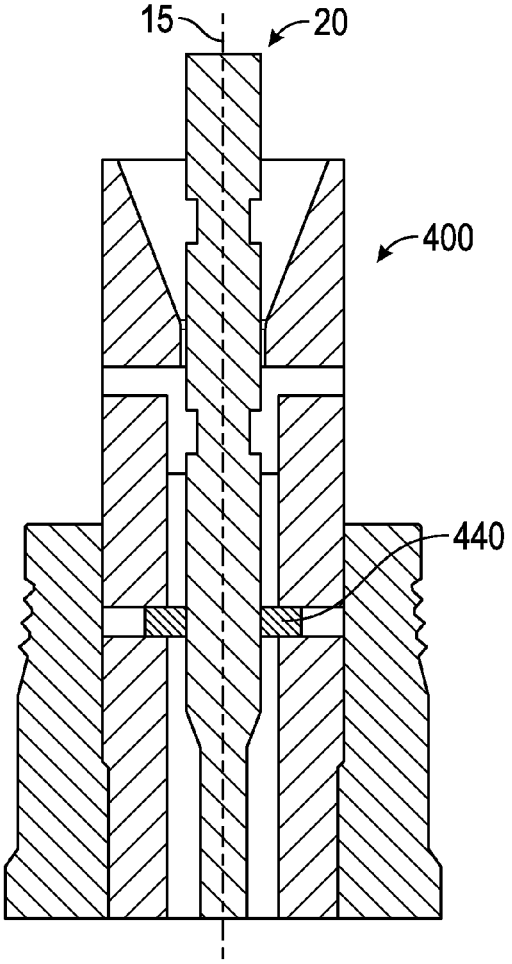
FIGS. 7A-7B are schematic cross sectional views of the fourth embodiment of the system of FIG. 5.
Figure 7B:
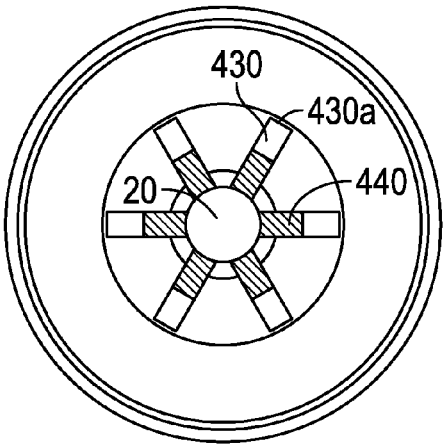

For illustrative purposes only, the ram 440 shown on the left side of FIG. 5 is in a retracted or unactuated position and the ram 440 shown on the right side of FIG. 5 is in an extended or actuated position. In operation, as the ESP string 20 (shown in FIG. 1) is lowered into the well 10, the sloped diameter portion 421 of the GPB upper end 401*a* guides the components of the ESP string 20 toward the center of through passage 420. When the ESP cable 40 is passing through the GPB 400, hydraulic fluid from the annulus line 89 flows through flow passage 465 in the GPB 400 to actuate the rams 440 to move from a retracted position at bore back surface 430*a* radially inward toward central axis 15 to an extended position (see FIG. 6B). When the components of the ESP string 20 having varying diameters pass through the GPB 400, the flow of the hydraulic fluid ceases, allowing the biasing member 450 to retract the rams 440 to an unactuated position. As each ESP string 20 component passes the rams 440, flow of the hydraulic fluid can be ceased to allow the biasing members 450 to retract the rams 450 radially outward toward bore back surface 430*a*.

Figure 8A:
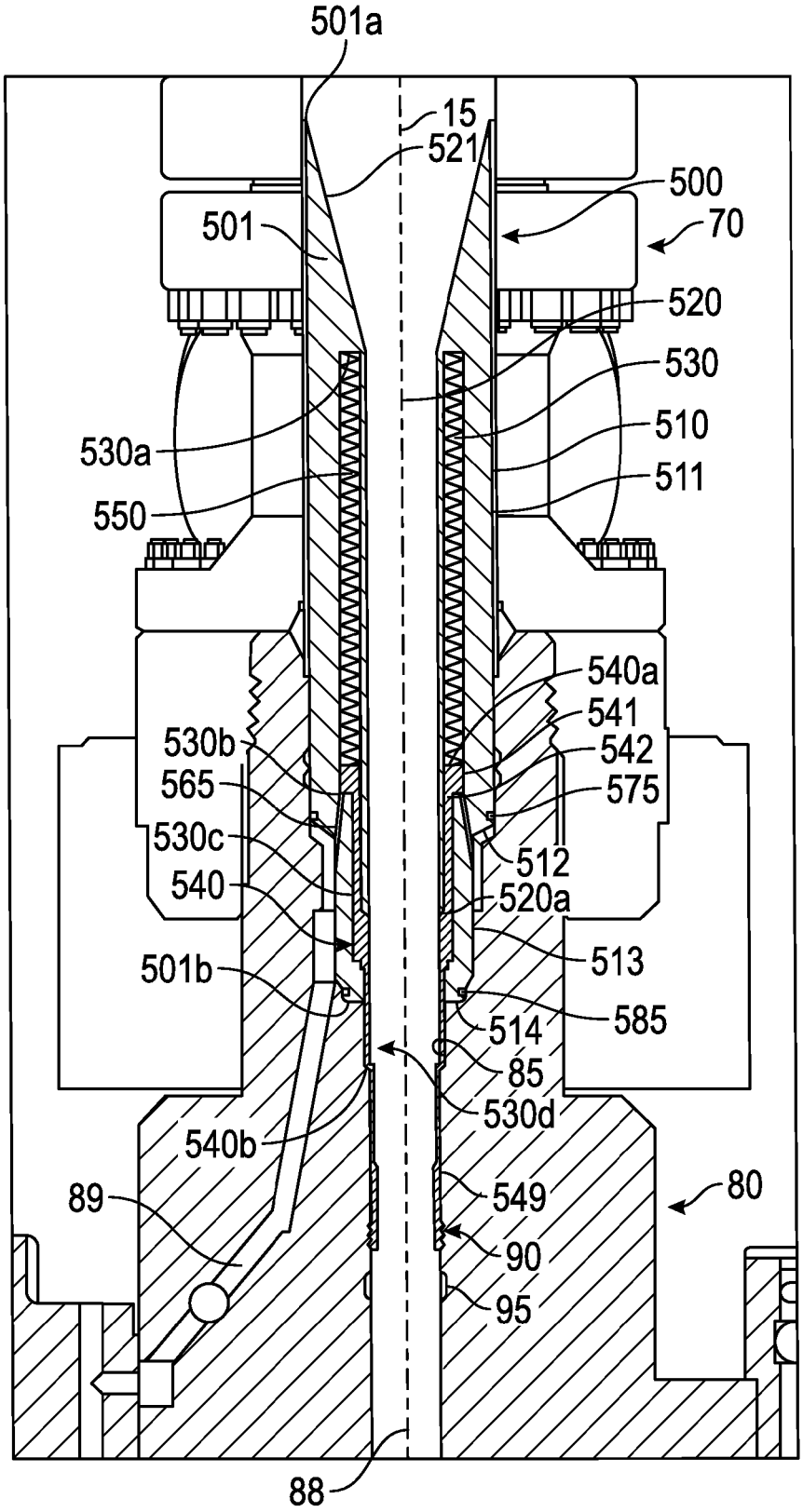
FIGS. 8A-8B are partial cross sectional views of a fifth embodiment of the system of FIG. 1.
Figure 8B:
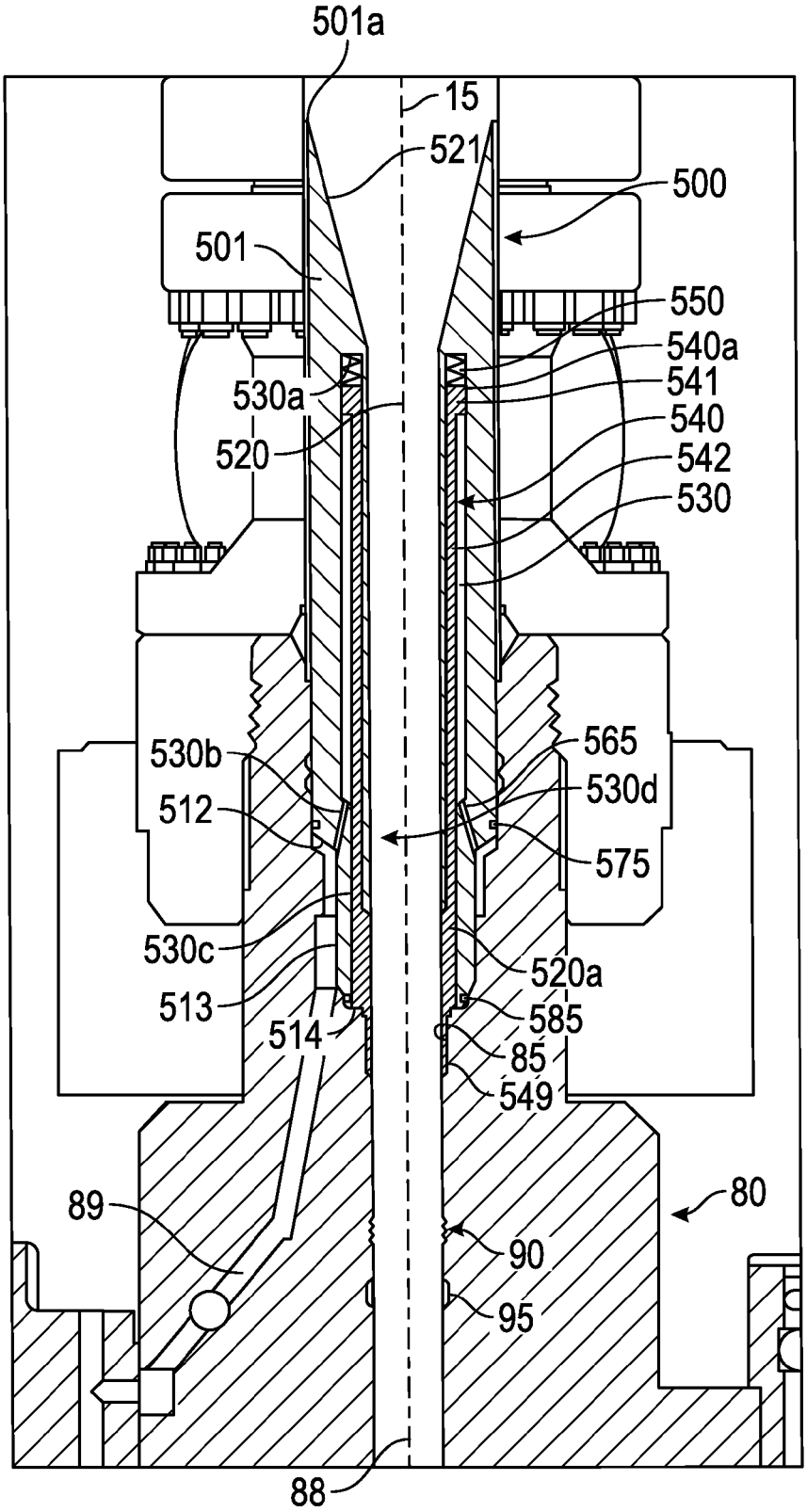

Referring now to FIGS. 8A and 8B, in a fifth embodiment, the GPB assembly 500 comprises a body 501 having an upper end 501*a*, a lower end 501*b*, an outer surface 510, and an inner through passage 520. The body upper end 501*a*, lower end 501*b*, and outer surface 510 are similar to those of body 101 shown in the first embodiment; like parts are designated with like or similar reference numerals. In the present embodiment, the body 501 comprises an annular cavity 530 having a first or upper end 530*a*, a partial shoulder 530*b*, a reduced diameter portion 530*c*, and an opening 530*d* that extends axially from an inner through passage end point 520*a* to body lower end 501*b*. Body 501 also includes a fluid passageway 565 in fluid communication with the annulus line 89 in the production system 80. In an embodiment, annulus line 89 may be annular bore 99 (shown in FIG. 1).

Body 501 further includes an annular piston 540 disposed in annular cavity 530. Annular piston 540 has a first end 540*a* and a second end 540*b*, and comprises a flange portion 541 at first end 540*a* and a first cylindrical portion 542 that extends from flange portion 541 to a second end 540*b*. Annular piston further comprises a plurality of protective elements 549 extending from piston second end 540*b*. Each protective element 549 is flexible and may have a narrow and long (i.e., finger-like) geometry or may be of another individual shape for combined protection.

Body 501 further comprises a biasing element 550 disposed in annular cavity 530 and coupled to annular cavity upper end 530*a* and piston first end 540*a*. The biasing element 550 in this embodiment is configured to bias the piston 540 in a downward position such as shown in FIG. 8A, such that the plurality of protective elements 549 cover the cable hanger lock profile 90 and sealing surface 95. The protective elements 549 may be made of any suitable material known in the art including, but not limited to, polymers, hard rubber, and soft metals. The biasing element 550 may be any type of suitable biasing member known in the art including, but not limited to, wave springs, elastomeric springs, and helical springs.

Referring still to FIGS. 8A and 8B, body 501 also includes grooves or cutouts with one groove proximate to a first downward-facing shoulder 512 of body 501 and one groove proximate to a second downward-facing shoulder 514 of body 501. Seals 575, 585 are disposed in the grooves to sealingly engage the body 501 with the production system 80 about an entrance to the fluid passageway 565 in body 501 to allow pressurization from an annulus line 89 in the production system 80. The annulus line 89 is in fluid communication with a flow passage 565 in the GPB 500. In an embodiment, annulus line 89 may be annular bore 99 (shown in FIG. 1).

In operation, as the ESP string 20 (shown in FIG. 1) is lowered into the well 10, the sloped diameter portion 521 of the GPB upper end 501*a* guides the components of the ESP string 20 toward the center of through passage 520. When the ESP string 20 is passing through the GPB 500, the piston 540 is in an unactuated position with the biasing element 550 maintaining the piston in the downward position shown in FIG. 8A. While in the unactuated position, the protective elements 549 are extended into bore 88 and cover the cable hanger lock profile 90. When the cable hanger 30 (shown in FIG. 1) is positioned a distance (e.g., approximately halfway) between the body upper end 501*a* and lower end 501*b*, hydraulic fluid from the annulus line 89 flows through flow passage 565 in the GPB 500 to force fluid against piston flange portion 541. The hydraulic fluid overcomes the force of the biasing element 550 and flows into cavity 530 by moving the piston flange 541 upward, thereby actuating the piston 540 to move toward an actuated position (see FIG. 8B). Once the piston 540 is fully actuated in the upper position, the protective elements 549 are proximate to second enlarged diameter portion 85 of the production system 80. The flexible nature of the protective elements 549 allows the protective elements 549 to expand to contact second enlarged diameter portion 85, which provides a smooth transition from inner through passage 520 to bore 88. Once the protective elements 549 are retracted into second enlarged diameter portion 85, the ESP string 20 can be lowered to allow cable hanger 30 to mate with cable hanger lock profile 90. In other embodiments, the length of the protective elements 549 can be shortened (e.g., made not as finger-like) to reduce the distance piston 540 must travel for the protective elements 549 to clear or uncover the cable hanger lock profile 90.

Figure 9A:
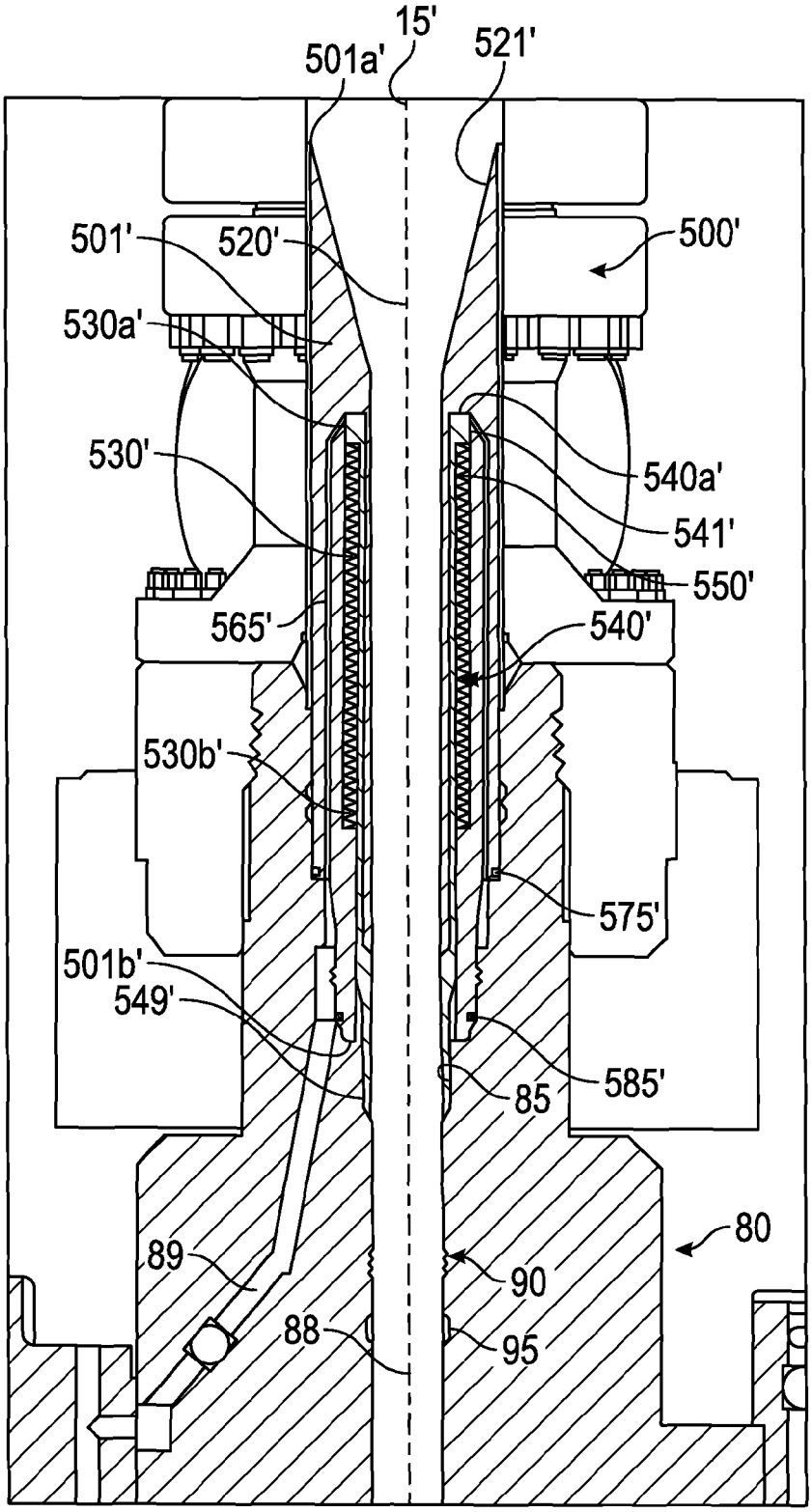
FIGS. 9A-9B are partial cross sectional views of an alternate fifth embodiment of the system of FIGS. 8A-8B.
Figure 9B:
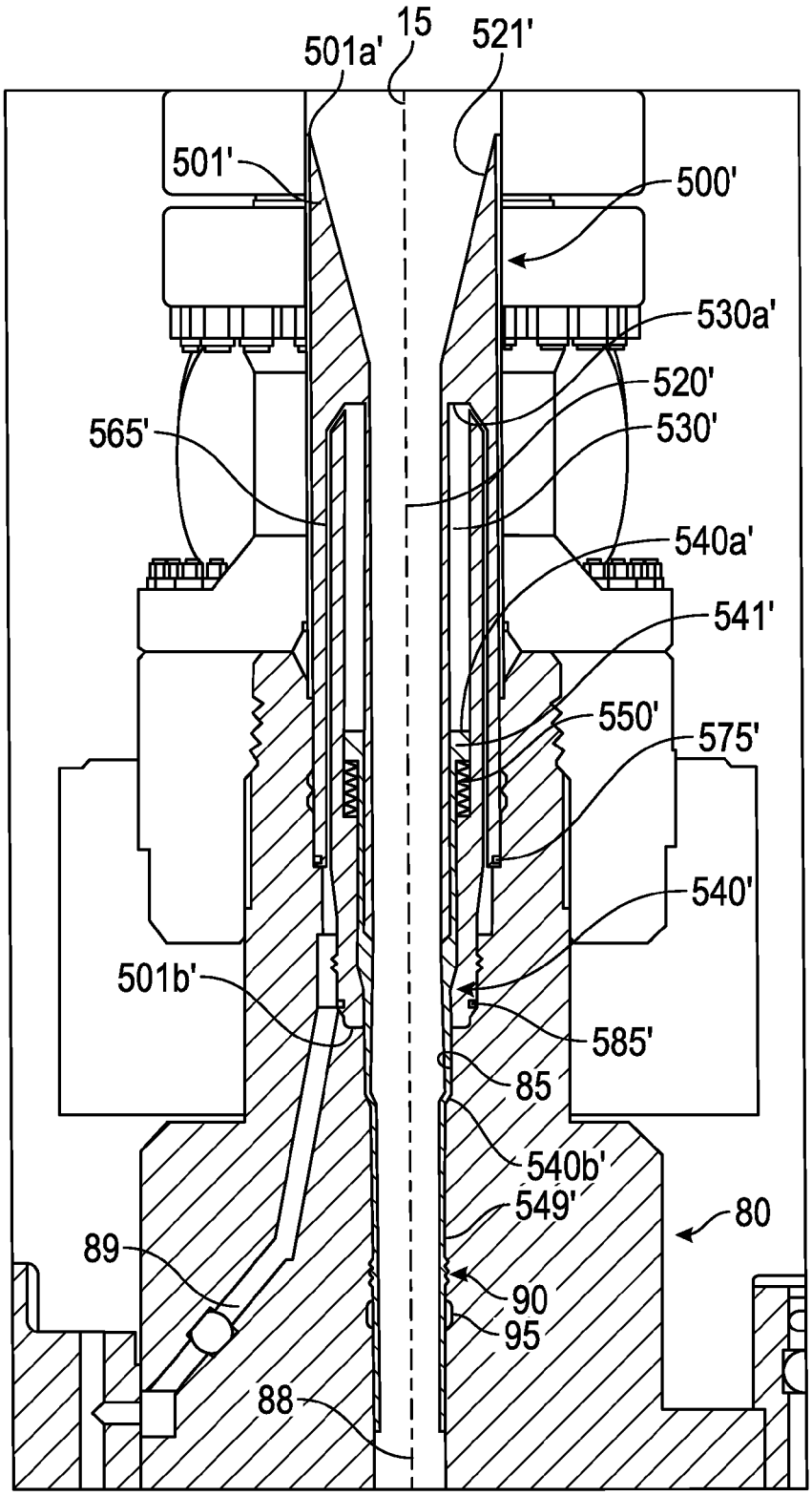

FIGS. 9A and 9B show an alternative version of the fifth embodiment, where the piston 540' is biased in the upward position (shown in FIG. 9A) and fluid passageway 565' is extended upward proximate to cavity upper end 530*a*'. Fluid from the annulus line 89 actuates the piston 540' to move axially downward to extend the protective elements 549' and cover the cable hanger lock profile 90.

In operation, as the ESP string 20 (shown in FIG. 1) is lowered into the well 10, the sloped diameter portion 521' of the GPB upper end 501*a*' guides the components of the ESP string 20 toward the center of through passage 520'. The piston 540' is in an unactuated position with the biasing element 550' maintaining the piston in the upward position shown in FIG. 9A. While in the unactuated position, the protective elements 549' are proximate to second enlarged diameter portion 85. The flexible nature of the protective elements 549' allows the protective elements 549' to expand and contact second enlarged diameter portion 85, which provides a smooth transition from inner through passage 520' to bore 88. Hydraulic fluid from the annulus line 89 then flows through flow passage 565' in the GPB 500' to force fluid against piston flange 541'. The hydraulic fluid overcomes the force of the biasing element 550' and flows into cavity 530' by moving the piston flange 541' downward, thereby actuating the piston 540' to move toward an actuated position (see FIG. 9B). While in the actuated position, the protective elements 549' are extended into bore 88 and cover the cable hanger lock profile 90.

The ESP string 20 is conveyed downhole with the ESP string 20 passing the cable hanger lock profile 90 while the protective elements 549' are covering and protecting the cable hanger lock profile 90 and sealing surface 95. When the cable hanger 30 (shown in FIG. 1) is positioned a distance (e.g., approximately halfway) between the body upper end 501*a*' and lower end 501*b*', hydraulic fluid from the annulus line 89 ceases flowing through flow passage 565' in the GPB 500' to allow the force of the biasing element 550' to overcome the hydraulic fluid in cavity 530' and move the piston flange 541' upward, thereby retracting the piston 540' back to the unactuated position (see FIG. 9A). Once the piston 540' is in the unactuated or upper position, the protective elements 549' are again proximate to second enlarged diameter portion 85 and the ESP string 20 can be lowered to allow cable hanger 30 to mate with cable hanger lock profile 90. In other embodiments, the length of the protective elements 549' can be shortened (e.g., made not as finger-like) to reduce the distance piston 540' must travel for the protective elements 549' to clear or uncover the cable hanger lock profile 90.

Figure 10:
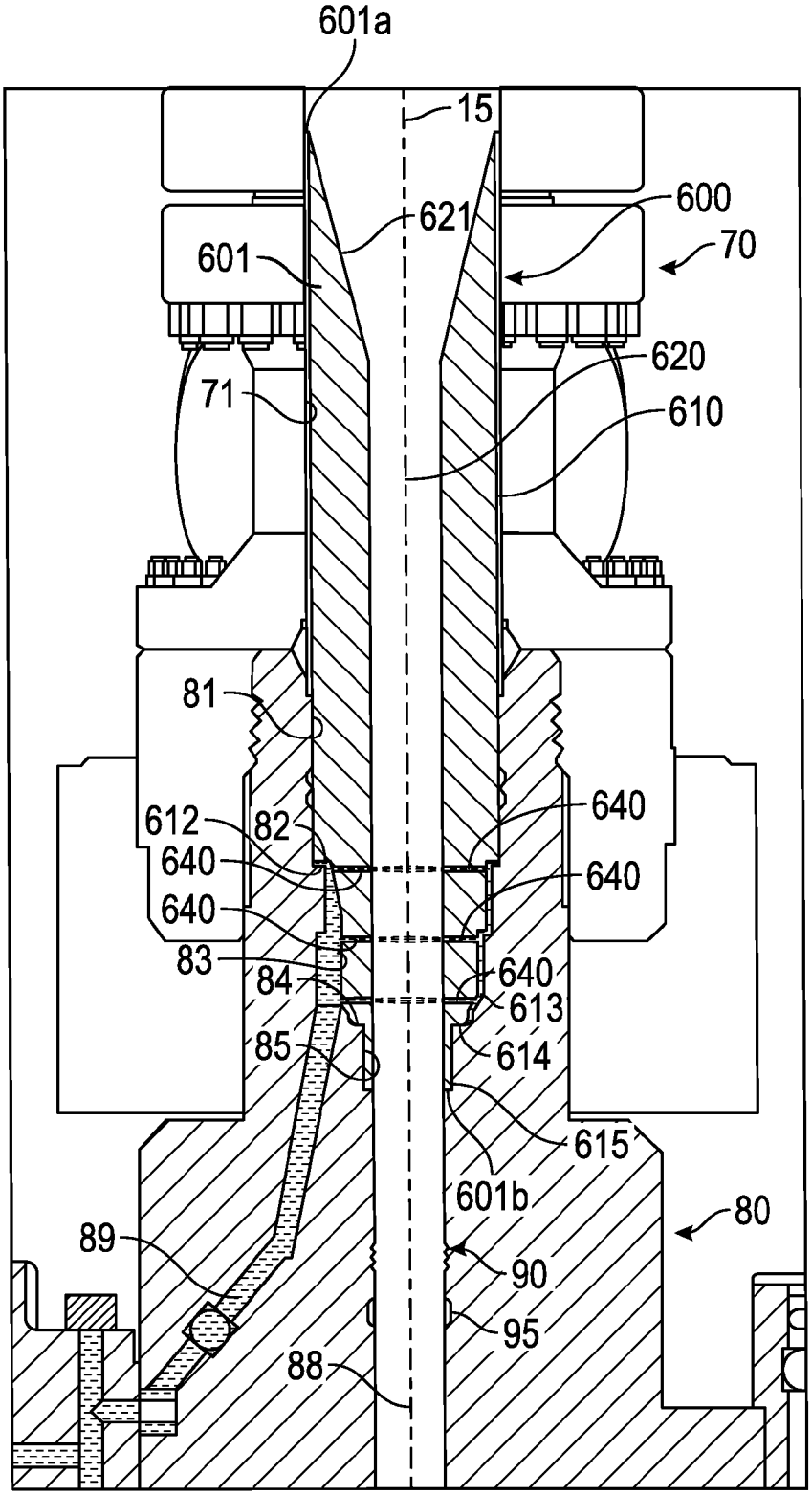
FIG. 10 is a partial cross sectional view of a sixth embodiment of the system of FIG. 1.

Referring now to FIG. 10, in a sixth embodiment, the GPB assembly 600 comprises a body 601 having an upper end 601*a*, a lower end 601*b*, an outer surface 610, and an inner through passage 620. The body upper end 601*a*, lower end 601*b*, and outer surface 610 are similar to those of body 101 shown in the first embodiment; like parts are designated with like or similar reference numerals. In the present embodiment, the body 601 comprises a plurality of circumferentially disposed nozzles or jets 640 radially directed toward central axis 15. Nozzles 640 are in fluid communication with and pressurized by fluid from annulus line 89. Nozzles 640 may be configured such that the force of the fluid exiting each nozzle is approximately the same. In operation, the force of the fluid flow exiting nozzles 640 centralizes the components of the ESP string 20 (shown in FIG. 1) as they pass through GPB 600. In an embodiment, annulus line 89 may be annular bore 99 (shown in FIG. 1).

Figure 11:
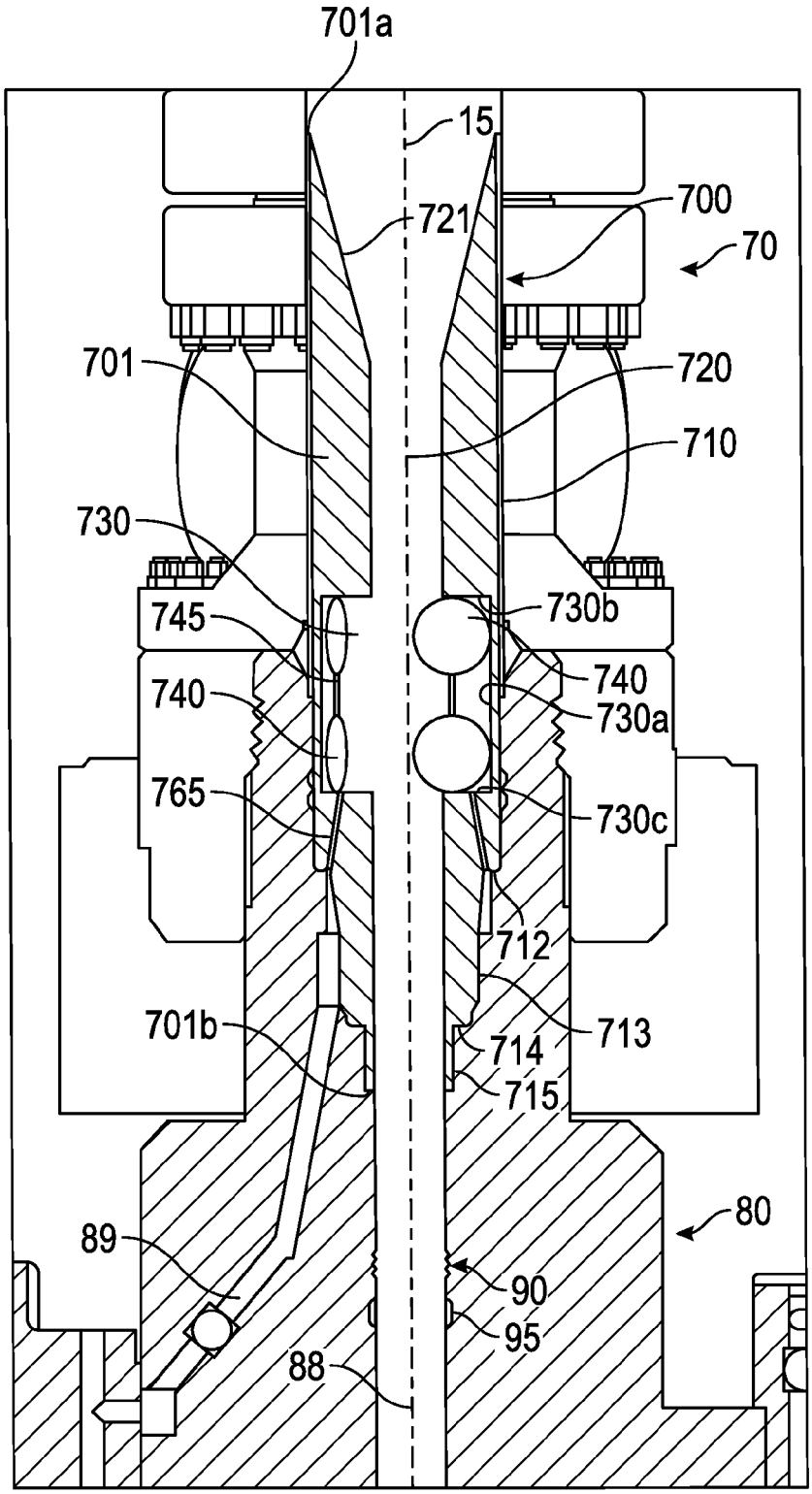
FIG. 11 is a partial cross sectional view of a seventh embodiment of the system of FIG. 1.

Referring now to FIG. 11, in a seventh embodiment, the GPB assembly 700 comprises a body 701 having an upper end 701*a*, a lower end 701*b*, an outer surface 710, and an inner through passage 720. The body upper end 701*a*, lower end 701*b*, and outer surface 710 are similar to those of body 101 shown in the first embodiment; like parts are designated with like or similar reference numerals. In the present embodiment, the inner through passage 720 comprises a coaxial cylindrical a bore or chamber 730 having a cylindrical surface 730*a*, an upper shoulder 730*b*, and a lower shoulder 730*c*. The inner diameter of the cylindrical surface 730*a* is larger than the inner diameter of the through passage 720.

Body 701 further includes a plurality of bladders 740 circumferentially disposed about central axis 15, each bladder being disposed in chamber 730. In the present embodiment, there are two rows of bladders 740 with one bladder 740 disposed above the other in each row. However, in alternative embodiments, only one bladder may be used in each row; further in other embodiments, fewer or more than two rows of bladders 740 may be used. The bladders 740 may be made of any suitable material known in the art including, but not limited to, polymers and rubber.

The bladders 740 are in fluid communication with each other through one or more connection tubes 745; the plurality of bladders 740 are also in fluid communication with and pressurized by fluid from annulus line 89. The plurality of bladders 740 are, thus, inflated by the fluid from the annulus line 89. For illustrative purposes only, the bladders 740 shown on the left side of FIG. 11 are deflated and the bladders 740 shown on the right side of FIG. 11 are inflated. In operation, the bladders 740 may be inflated the same amount, which centralizes the components of the ESP string 20 (shown in FIG. 1) as they pass through GPB 700. In an embodiment, annulus line 89 may be annular bore 99 (shown in FIG. 1).

Figure 12:
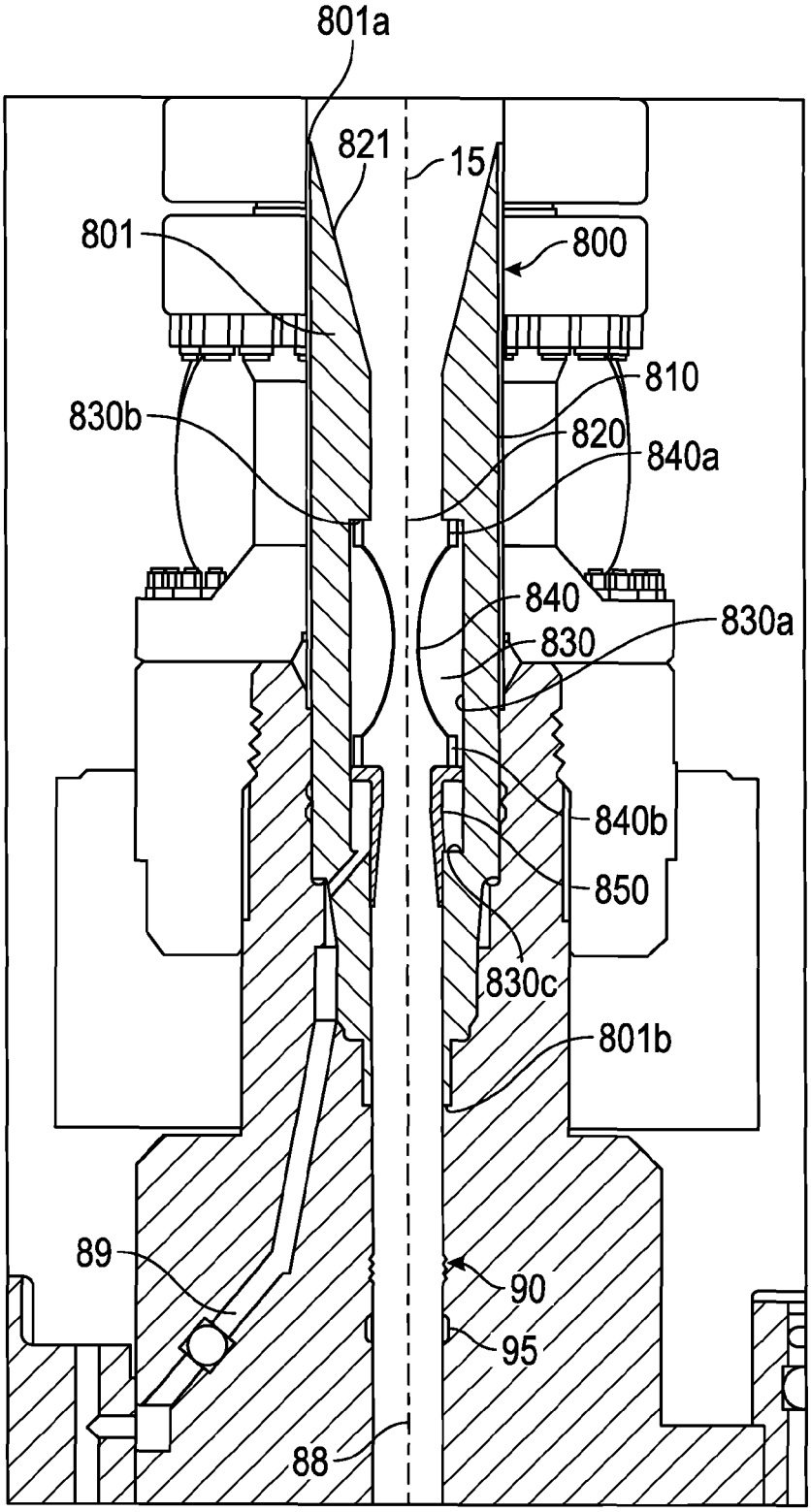
FIG. 12 is a partial cross sectional view of an eighth embodiment of the system of FIG. 1.

Referring now to FIG. 12, in an eighth embodiment, the GPB assembly 800 comprises a body 801 having an upper end 801*a*, a lower end 801*b*, an outer surface 810, and an inner through passage 820. The body upper end 801*a*, lower end 801*b*, and outer surface 810 are similar to those of body 101 shown in the first embodiment; like parts are designated with like or similar reference numerals. In the present embodiment, the body 801 comprises a plurality of leaf springs 840 circumferentially disposed about central axis 15. In the present embodiment, four leaf springs 840 (only two shown in cross section), each having a first or upper end 840*a* and a second or lower end 840*b*, are coupled to an upper shoulder 830*b* of a cutout 830 at first end 840*a*, and coupled to a hydraulically actuated annular piston 850 at second end 840*b*. In other embodiments, a different number or arrangement of leaf springs may be used, the first end 840*a* of each leaf spring 840 may be coupled to a hydraulically actuated annular piston 850, and/or the second end 840*b* of each leaf spring 840 may be coupled to the lower shoulder 830*c* of cutout 830.

The piston 850 is in fluid communication with and pressurized by fluid from annulus line 89. The piston 850 is, thus, actuated by the fluid from the annulus line 89. In operation, the hydraulically actuated piston 850 axially extends and simultaneously reduces the effective bore diameter of GPB 800 with leaf springs 840, which centralizes the components of the ESP string 20 (shown in FIG. 1) as they pass through GPB 800. The amount of axial displacement of the piston 850 can vary, thus allowing the leaf springs to accommodate the various diameters of the ESP string 20 components.

Referring now to FIGS. 13A-13D and 14, in a ninth embodiment, the GPB assembly 900 comprises a body 901 having an upper end 901*a* on a first portion 902, a lower end 901*b* on a second portion 903, an outer surface 910, and an inner through passage 920. The body upper end 901*a*, lower end 901*b*, and outer surface 910 are similar to those of body 101 shown in the first embodiment; like parts are designated with like or similar reference numerals. In the present embodiment, the first portion 902 of body 901 includes a sloped internal surface 902*a*, and the second portion 903 of body 901 comprises an annular cavity 930 having a surface 930*a*, an upper end 930*b*, and a lower end 930*c*. A flange 905 is coupled to the second portion 903 in cavity 930 at upper end 930*b*.

Body 901 further includes a plurality of centering disks 940 separated by spacers 950 disposed in annular cavity 930. Each spacer 950 is generally annular and may have a diameter essentially equivalent to a diameter of each centering disk 940. The lowest centering disk 940 engages lower end 930*c* and a spacer 950 rests on top of the disk 940. Additional spacers 950 and centering disks 940 are stacked one on top the other. In the present embodiment, five centering disks 940 are separated by five spacers 950. In other embodiments, more or fewer spacers 940 and disks 950 may be used; further, the height of each spacer 950 may be increased or decreased to adjust the distance between the disks 940. The centering disks 940 and spacers 950 are held in place by the flange 905. The flange 905 may be coupled to body 901 by any suitable fastener known in the art including, but not limited to, threaded fasteners and bolts. The first portion 902 of body 901 is coupled to the flange 905 and the second portion 903 by a thread or any suitable fasteners known in the art including, but not limited to, threaded fasteners and bolts. For example, axially oriented bolts may be used to secure the first portion 902 to the second portion 903, securing the flange 905 in the process.

Figure 14:
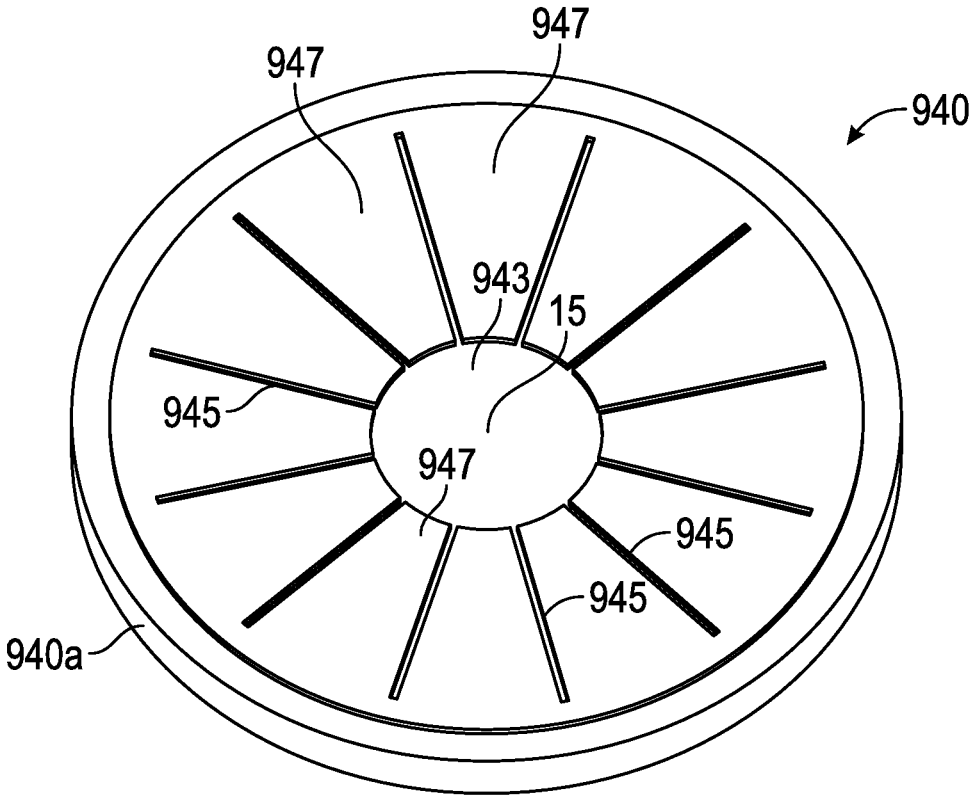
FIG. 14 is a perspective view of a centering disk of the system of FIGS. 13A-13D.

As shown in FIG. 14, each spacer 940 may be generally circular with a cylindrical outer surface 940*a* and a circular cutout 943 coaxial with central axis 15. Spacer 940 further comprises a plurality of circumferentially spaced radial slots 945 that extend radially outward from circular cutout 943 toward and proximate to cylindrical outer surface 940*a*. The plurality of slots 945 forms a corresponding plurality of wedge-shaped flaps 947. The flaps 947 are flexible and thus can bend either upward or downward. The spacer 940 may be made of any suitable material known in the art including, but not limited to, polymers and rubber.

Figure 13B:
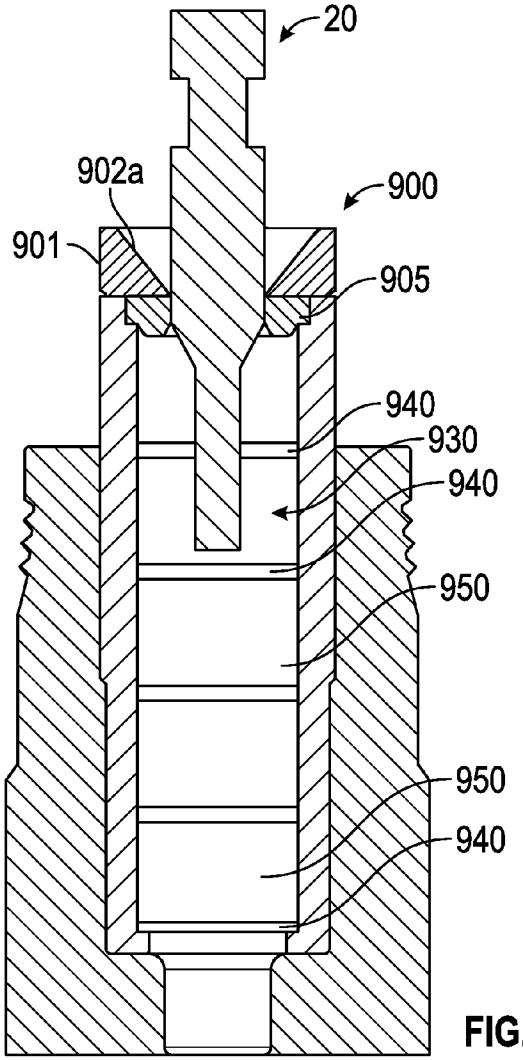
FIGS. 13A-13D are schematic cross sectional views of a ninth embodiment of the system of FIG. 1.
Figure 13A:
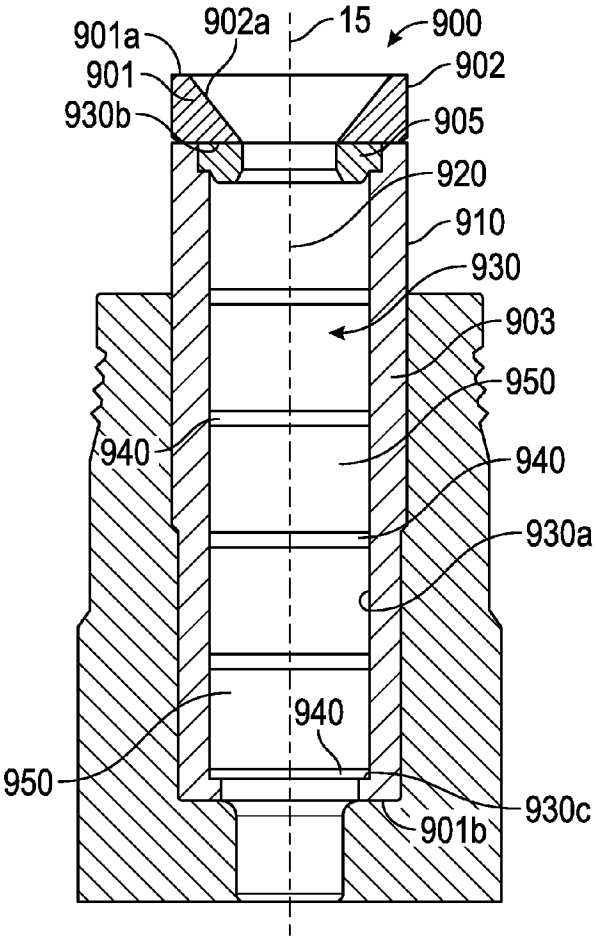
Figure 13D:
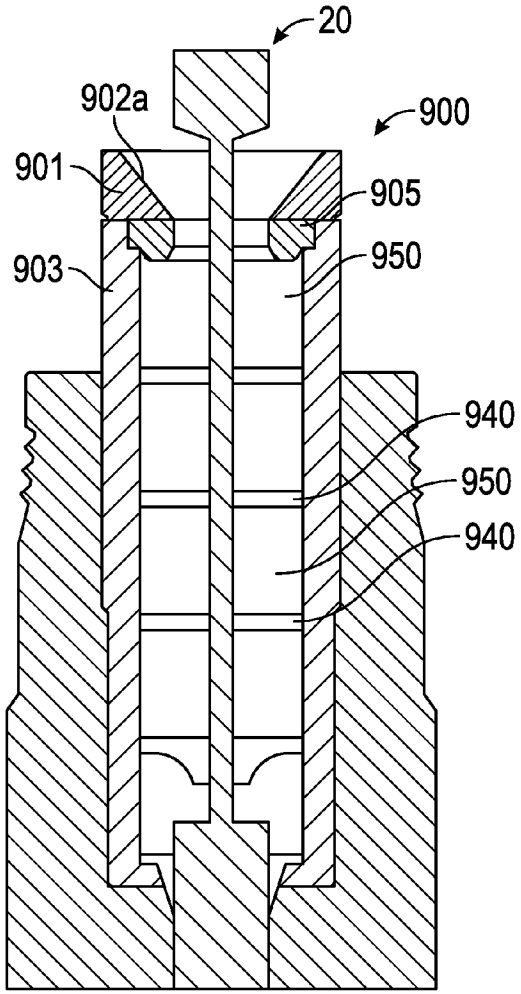
Figure 13C:
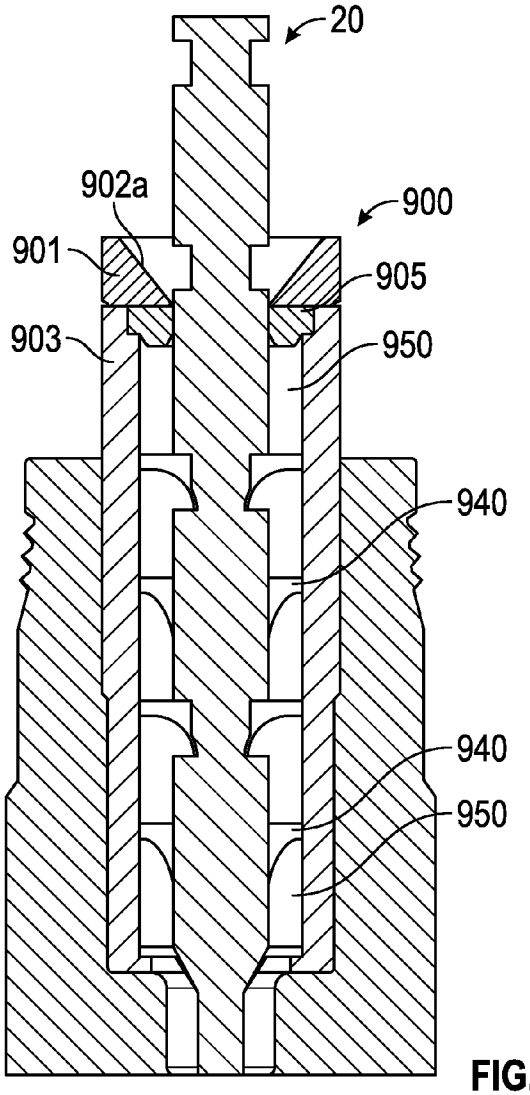

In operation, as the ESP string 20 (shown in FIG. 1) is lowered into the well 10, the sloped internal surface 902*a* of the GPB first portion 902 guides the components of the ESP string 20 toward the center of through passage 920. The components of the ESP string 20 engage the flaps 947, and as each component of the ESP string 20, which have varying diameters, reaches the flaps 947, the component exerts a force on the flaps 947 and causes the flaps to move axially downward (when conveying the ESP string 20 downhole, and upward when removing the ESP string 20). The flaps 947 accommodate each ESP string 20 component as it passes regardless of the component's diameter, as best shown in FIG. 13C. As each ESP string 20 component passes the flaps 947, the flaps 947 move axially upward or downward back to the unactuated position. The flaps 947 centralize each ESP string 20 component regardless of diameter. The GPB 900, thus, acts as a variable centralizer to keep each ESP string 20 component centered in the inner through passage 920 and subsequently in the bore 88. Keeping the ESP string 20 centered prevents the ESP string 20 from contacting the sealing surface 95 as the ESP passes through the cable hanger lock profile 90, thus reducing the risk of damage to the sealing surface 95.

Figure 15A:
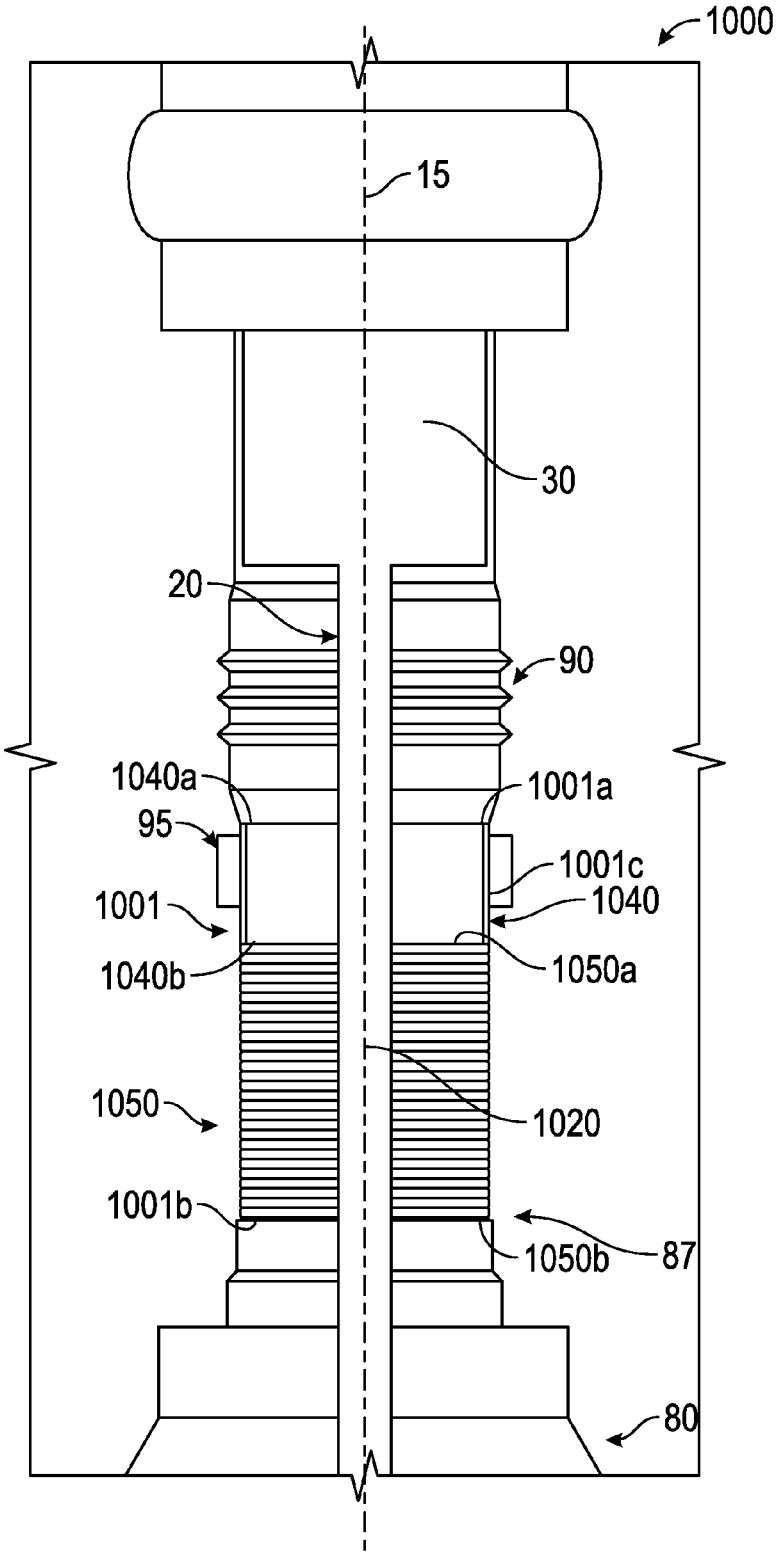
FIGS. 15A-15B are schematic views of a tenth embodiment used in conjunction with the system of FIG. 2.
Figure 15B:
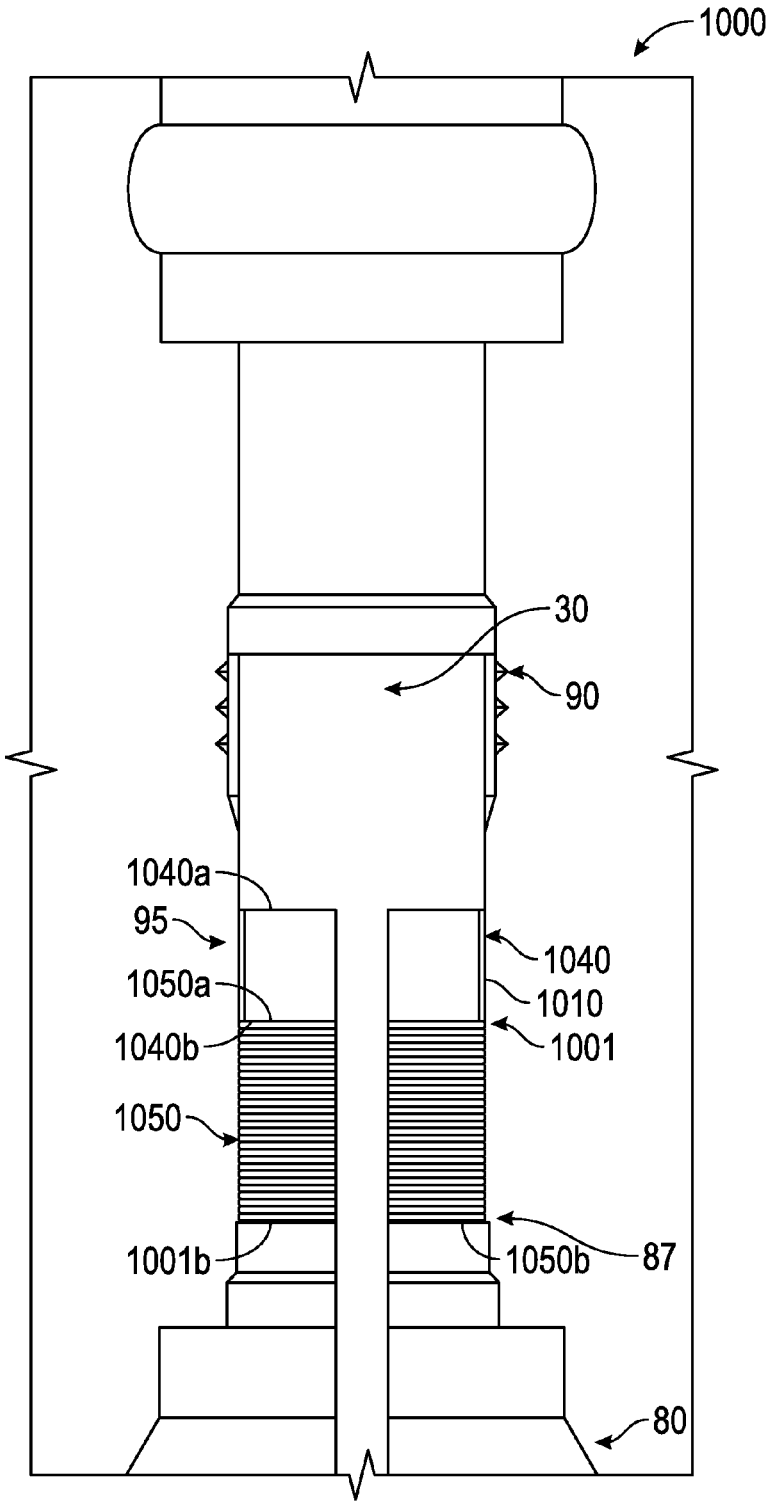

Referring now to FIGS. 15A and 15B, in a tenth embodiment, the GPB assembly 1000 comprises the GPB assembly 100 of the first embodiment (not shown) and a protective sleeve assembly 1001 having an upper end 1001*a*, a lower end 1001*b*, an outer surface 1001*c*, and an inner through passage 1020. Protective sleeve assembly 1001 further comprises a sleeve 1040 and a biasing member 1050. The sleeve 1040 is cylindrical and has a first end 1040*a* opposite a second end 1040*b*. The sleeve 1040 has a diameter large enough to allow all components of the ESP string 20 (shown in FIG. 1) to pass therethrough except the cable hanger 30 (shown in FIG. 1). The sleeve second end 1040*b* is coupled to a first end 1050*a* of the biasing element 1050, and a second end 1050*b* of the biasing member is coupled to a shoulder 87 within the production system 80. The biasing member 1050 and the sleeve 1040 are configured such that when installed and in an unactuated state in the production system 80, the sleeve 1040 will cover the sealing surface 95.

The biasing member 1050 may be any type of suitable biasing member known in the art including, but not limited to, helical springs, wave springs, elastomeric springs, and leaf springs.

During operation, as the ESP string 20 is lowered into the well 10, the sloped diameter portion 121 of the upper end 101*a* of GPB 100 (not shown) guides the components of the ESP string 20 toward the center of through passage 120. The ESP string 20 components then pass through sleeve 1040 and biasing member 1050. Once the cable hanger 30 reaches the sleeve first end 1040*a*, the cable hanger 30, having an outer diameter greater than an inner diameter of the sleeve 1040, will contact sleeve first end 1040*a* and as the cable hanger 30 continues to move downward, will push the sleeve 1040 with it. As the sleeve 1040 is pushed downward, the sealing surface 95 is exposed and the biasing member 1050 is actuated and will compress. The biasing member 1050 is further configured to compress until the cable hanger 30 is aligned with and engaging the cable hanger lock profile 90 to seal and lockdown to the production system 80. Thus, the sleeve 1040 protects the sealing surface 95 from the components of the ESP string 20 as they pass through cable hanger lock profile 90 and sealing surface 95, and the sleeve 1040 only exposes the sealing surface for the cable hanger 30.

Figure 16A:
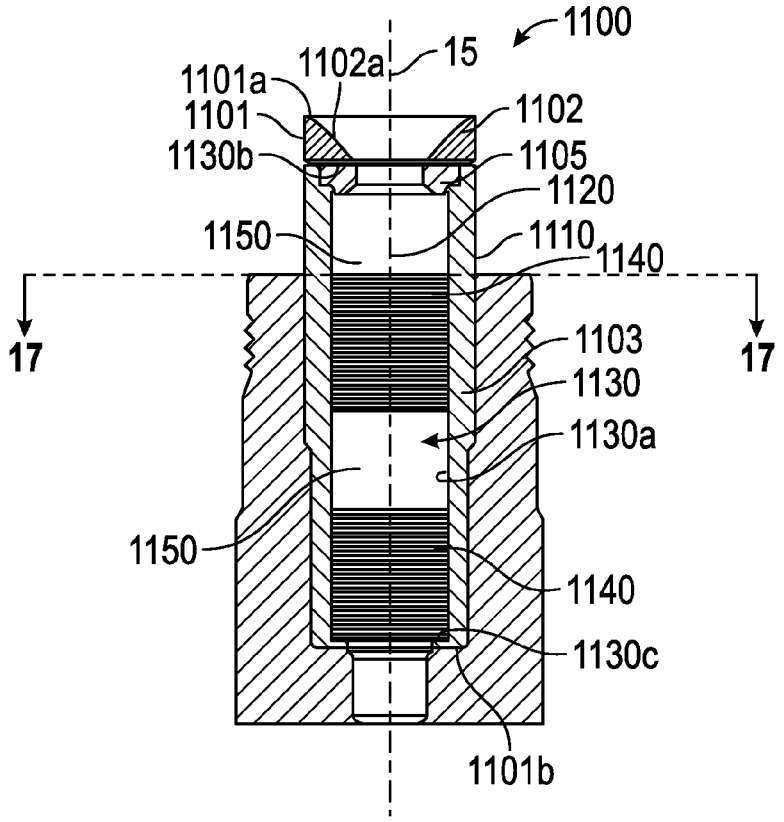
FIGS. 16A-16B are partial cross sectional views of an eleventh embodiment of the system of FIG. 1.
Figure 16B:
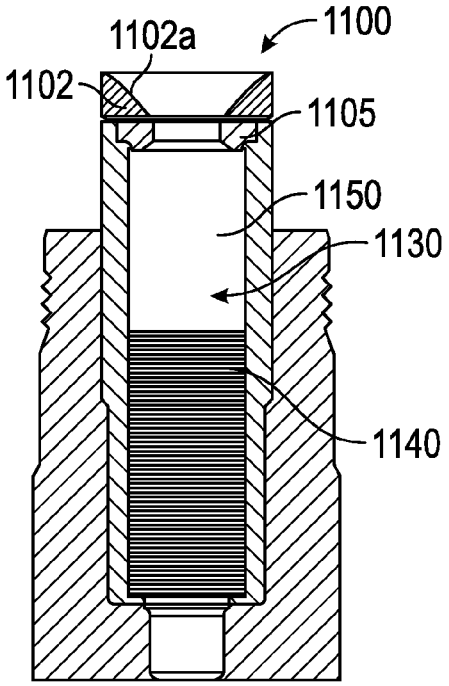
Figure 17A:
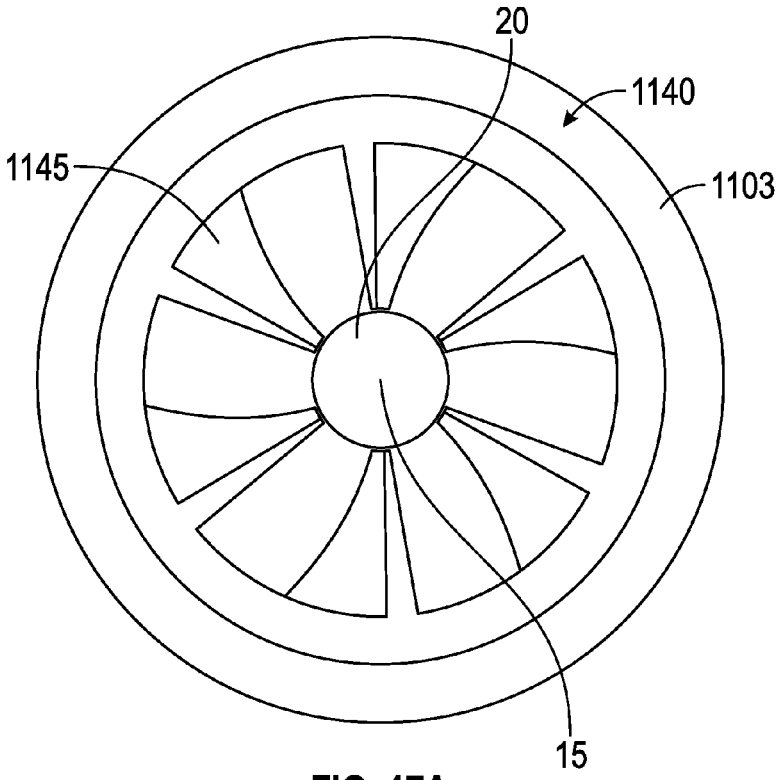
FIGS. 17A-17B are schematic top views of a centering device of the system of FIGS. 16A-16B.
Figure 17B:
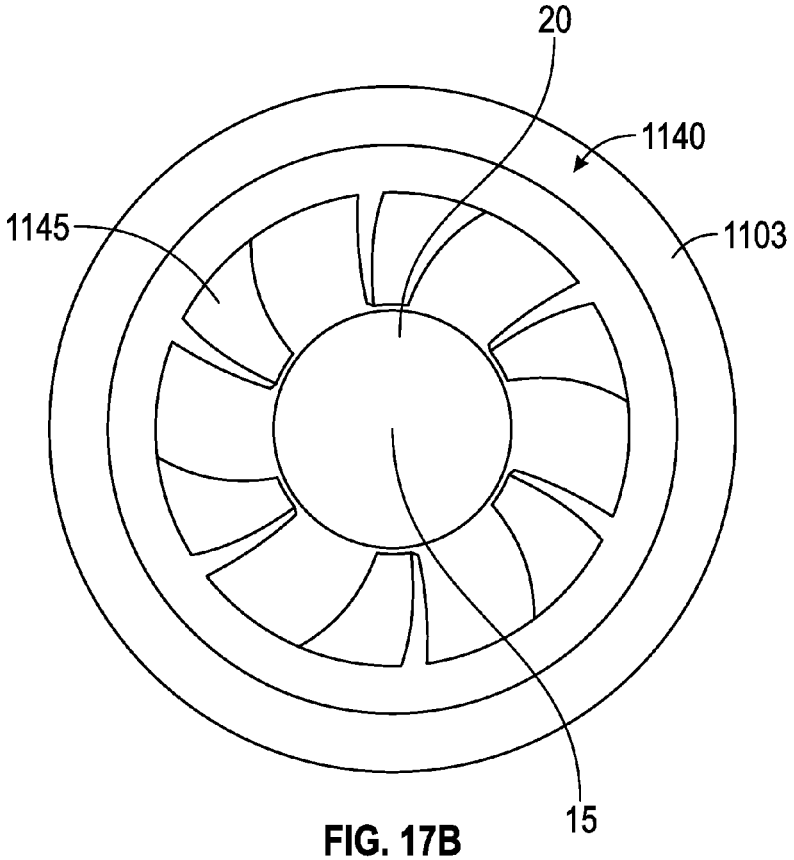

Referring now to FIGS. 16A-16B, in an eleventh embodiment, the GPB assembly 1100 comprises a body 1101 having an upper end 1101*a* on a first portion 1102, a lower end 1101*b* on a second portion 1103, an outer surface 1110, and an inner through passage 1120. The body upper end 1101*a*, lower end 1101*b*, and outer surface 1110 are similar to those of body 901 shown in the ninth embodiment; like parts are designated with like or similar reference numerals. In the present embodiment, the first portion 1102 includes a sloped internal surface 1102*a*, and the second portion 1103 of body 1101 comprises an annular cavity 1130 having a cylindrical surface 1130*a*, an upper end 1130*b*, and a lower end 1130*c*. A flange 1105 is coupled to second portion 1103 in cavity 1130 at upper end 1130*b*.

Figure 18A:
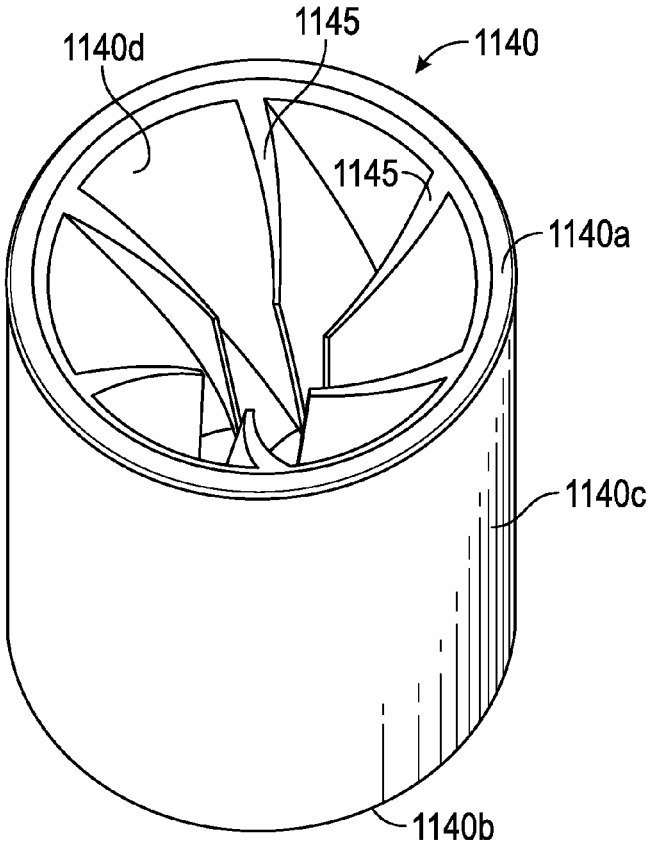
FIGS. 18A-18D are various schematic views of the centering disk of the system of FIGS. 16A-16B.
Figure 18B:
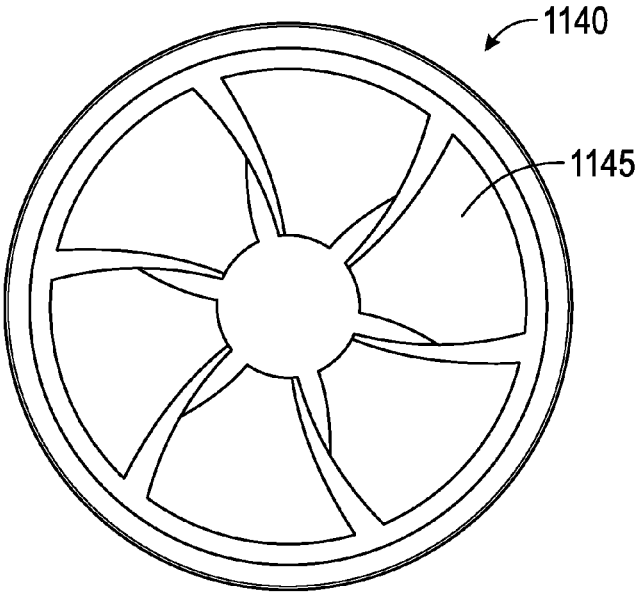
Figure 18C:
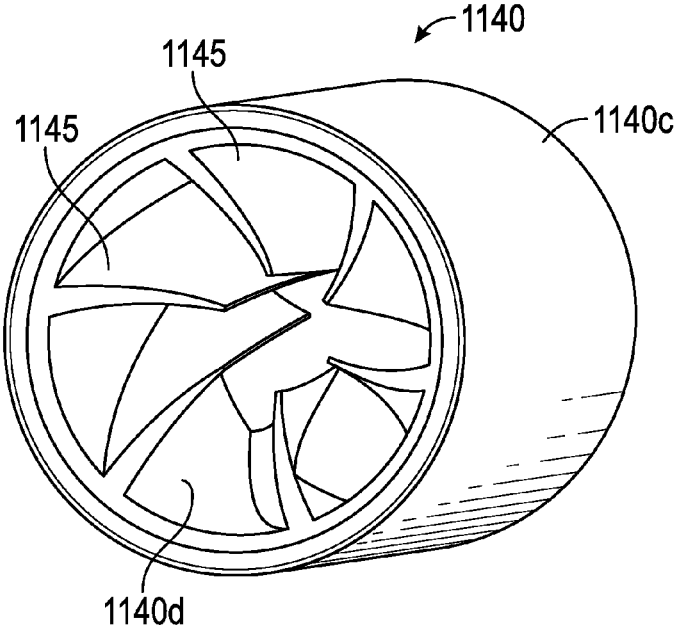
Figure 18D:
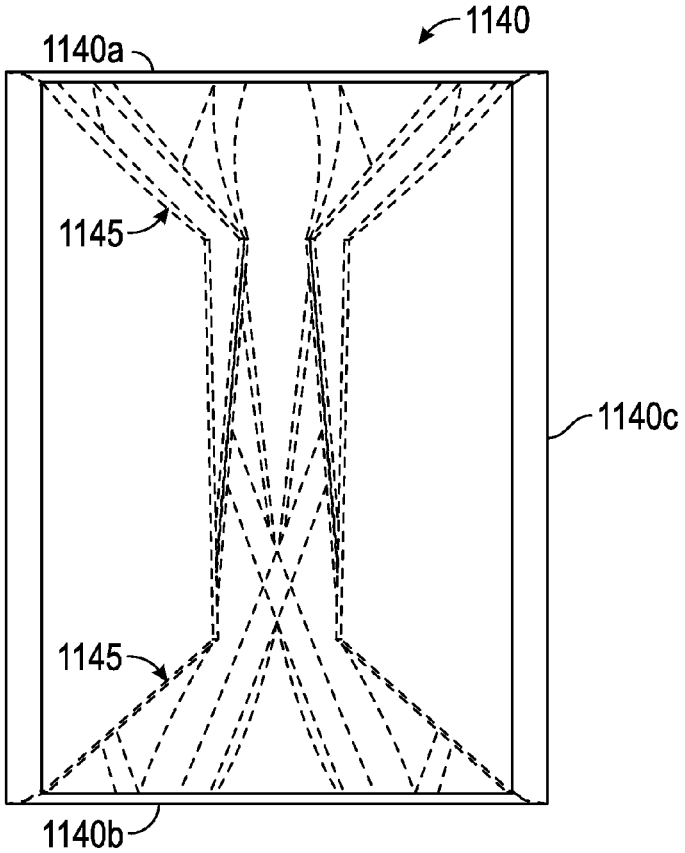

Body 1101 further includes at least one centering device 1140 disposed in annular cavity 1130. As shown in FIG. 18A, each centering device 1140 may be generally cylindrical having a first end 1140*a*, a second end 1140*b*, a cylindrical outer surface 1140*c*, and a cylindrical inner surface 1140*d* that includes a plurality of fins 1145. The fins 1145 may be uniformly circumferentially and angularly spaced about axis 15. In this embodiment, centering device 1140 includes six uniformly circumferentially-spaced fins 1145. In general, the centering device 1140 can include any suitable number of fins 1145 (e.g., three, four, five, or more fins 1145), and further, the circumferential spacing of the fins can be uniform or non-uniform. Further, the fins 1145 may be oriented at any angle between 0° and 180° relative to the central axis 15.

As in the ninth embodiment shown in FIGS. 13A-13D, more than one centering device 1140 may be used, and the centering devices 1140 may be separated by spacers 1150 similar to spacer 950 of the ninth embodiment. The lowest centering device 1140 is disposed at the lower end 1130*c* of cavity 1130, and a spacer 1150 rests on top of the centering device 1140. Additional spacers 1150 and centering devices 1140 can be stacked one on top of the other. In an embodiment, three centering devices 1140 are separated by three spacers 1150. In other embodiments, more spacers 1140 and centering devices 1150 may be used; further, the height of each spacer 1150 may be increased or decreased to adjust the distance between the devices 1140. In the present embodiment shown in FIG. 16A, two centering devices 1140 are separated by two spacers 1150. The centering devices 1140 and spacers 1150 are held in place by the flange 1105. The flange 1105 may be coupled to body 1101 by any suitable fastener known in the art including, but not limited to, threaded fasteners and bolts. The first portion 1102 of body 1101 is coupled to the flange 1105 and the second portion 1103 by any suitable fasteners known in the art including, but not limited to, threaded fasteners and bolts. For example, axially oriented bolts may be used to secure the first portion 1102 to the second portion 1103, securing the flange 1105 in the process. In the embodiment shown in FIG. 16B, one centering device 1140 is disposed in cavity 1130 and the first portion 1102 is coupled to the flange 1105 and the second portion 1103.

Referring now to FIGS. 17A-17B and 18A-18D, the plurality of fins 1145 are flexible and, thus, can bend or flex radially and angularly outward or inward. The centering device 1140 may be made of any suitable material known in the art including, but not limited to, polymers and rubber.

In operation, as the ESP string 20 (shown in FIGS. 17A-17B) is lowered into the well 10, the sloped internal surface 1102*a* of first portion 1102 of the GPB upper end 1101*a* guides the components of the ESP string 20 toward the center of through passage 1120 (shown in FIGS. 16A-16B). The components of the ESP string 20 engage the fins 1145, and as each component of the ESP string 20, which have varying diameters, reaches the fins 1145, the component exerts a force on the fins 1145 and causes the fins to move radially outward. The fins 1145 accommodate each ESP string 20 component as it passes regardless of the component's diameter. As each ESP string 20 component passes the fins 1145, the fins 1145 move radially inward back to the unactuated position. The fins 1145 centralize each ESP string 20 component regardless of diameter. The GPB 1100 thus acts as a variable centralizer to keep each ESP string 20 component centered in the inner through passage 1120 and subsequently in the bore 88. Keeping the ESP string 20 centered prevents the ESP string 20 components from contacting the sealing surface 95 as the ESP passes through the cable hanger lock profile 90, thus reducing the risk of damage to the sealing surface 95.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order.

What is claimed is:

1. A variable guide and protection bushing assembly for guiding a string of components to a cable hanger sealing surface disposed in a well production system, the well production system having an intervention member installed thereon, the assembly mountable to the well production system and comprising:

a body having a central axis, a first end, a second end, an outer surface, and an inner through passage, wherein the outer surface at the second end is configured to be coupled to the production system;

a cylindrical cutout disposed in and coaxial with the inner through passage, the cutout forming a cylindrical surface having a larger diameter than a diameter of the inner through passage; and a variable centralizer component disposed in and coaxial with the cylindrical cutout and moveable radially inward and outward in response to a component of the string of components passing through the cylindrical cutout.

2. The variable guide and protection bushing assembly of claim 1, wherein the variable centralizer component comprises a plurality of rollers disposed circumferentially about the central axis;

wherein each roller is coupled to a biasing member, and each biasing member is coupled to the cylindrical surface; and wherein the plurality of rollers is interconnected and movement of one of the plurality of rollers moves the rollers proximate to the one of the plurality of rollers.

3. The variable guide and protection bushing assembly of claim 2, wherein the biasing member is a helical spring, a wave spring, an elastomeric spring, or a leaf spring.

4. The variable guide and protection bushing assembly of claim 1, wherein the cylindrical surface has an upper shoulder and a lower shoulder;

wherein the variable centralizer component comprises a plurality of leaf springs having a first end and a second end and disposed circumferentially about the central axis;

wherein each leaf spring is coupled at the first end to the upper shoulder and at the second end to a biasing member;

wherein the biasing member is coupled to the lower shoulder and is moveable axially in response to a radial movement of the plurality of leaf springs.

5. The variable guide and protection bushing assembly of claim 1, wherein the variable centralizer component comprises a plurality of rams disposed circumferentially about the central axis;

wherein each ram is in fluid communication with an annulus line of the production system and is coupled to at least one biasing member that is coupled to the cylindrical surface;

wherein the at least one biasing member is biased in a retracted position toward the cylindrical surface;

wherein the plurality of rams is moveable radially inward toward the central axis in response to a hydraulic force supplied from the annulus line, and moveable radially outward upon removal of the hydraulic force and in response to a force from the at least one biasing member.

6. The variable guide and protection bushing assembly of claim 5, wherein the cylindrical surface has an upper shoulder and a lower shoulder; and wherein seals are disposed between the plurality of rams and the upper shoulder and between the plurality of rams and the lower shoulder.

7. The variable guide and protection bushing assembly of claim 1, wherein the cylindrical surface has an upper shoulder and a lower shoulder;

wherein the variable centralizer component comprises a plurality of bladders disposed circumferentially about the central axis;

wherein the plurality of bladders is configured to be in fluid communication with an annulus line of the production assembly;

wherein the plurality of bladders expand in response to a hydraulic force supplied from the annulus line, and deflate in response to a removal of the hydraulic force.

8. The variable guide and protection bushing assembly of claim 1, wherein the cylindrical surface has an upper shoulder and a lower shoulder;

wherein the variable centralizer component comprises a plurality of leaf springs having a first end and a second end and disposed circumferentially about the central axis;

wherein each leaf spring is coupled at the first end to the upper shoulder and at the second end to a piston; and wherein the piston is coupled to the lower shoulder and moveable axially in response to a radial movement of the plurality of leaf springs.

9. A variable guide and protection bushing assembly for guiding a string of components to a cable hanger sealing surface disposed in a well production system, the well production system having an intervention member installed thereon, the assembly mountable to the well production system and comprising:

a body having a central axis, a first end, a second end, an outer surface, and an inner through passage, wherein the outer surface at the second end is configured to be coupled to the production system;

an annular cavity disposed in and coaxial with the body, the annular cavity forming a cylindrical surface having a shoulder, and a larger diameter than a diameter of the inner through passage;

a piston disposed in the annular cavity, the piston in fluid communication with an annulus line of the production system and coupled to a biasing member, and the biasing member being coupled to the shoulder; and a plurality of protective elements extending from the piston and into the production system.

10. The variable guide and protection bushing assembly of claim 9, wherein the piston is biased in an extended position away from the shoulder via the biasing member;

wherein the piston is configured to move axially toward the shoulder in response to a hydraulic force supplied from the annulus line and axially away from the shoulder to the extended position upon removal of the hydraulic force and in response to a force from the biasing member;

wherein the plurality of protective elements cover the cable hanger sealing surface when the piston is in the extended position, and expose the cable hanger sealing surface when the piston moves axially toward the shoulder.

11. The variable guide and protection bushing assembly of claim 9, wherein the piston is biased in a retracted position toward the shoulder via the biasing member;

wherein the piston is configured to move axially away from the shoulder in response to a hydraulic force supplied from the annulus line and axially toward the shoulder to the retracted position upon removal of the hydraulic force and in response to a force from the biasing member;

wherein the plurality of protective elements expose the cable hanger sealing surface when the piston is in the retracted position, and cover the cable hanger sealing surface when the piston moves axially away from the shoulder.

12. A variable guide and protection bushing assembly for guiding a string of components to a cable hanger sealing surface disposed in a well production system, the well production system having an intervention member installed thereon, the assembly mountable to the well production system and comprising:

a body having a central axis, a first end, a second end, an outer surface, and an inner through passage, wherein the outer surface at the second end is configured to be coupled to the production system; and a plurality of nozzle jets disposed circumferentially about and radially directed toward the central axis;

wherein the nozzle jets are in fluid communication with an annulus line of the production assembly.

13. A variable guide and protection bushing assembly for guiding a string of components to a cable hanger sealing surface disposed in a well production system, the well production system having an intervention member installed thereon, the assembly mountable to the well production system and comprising:

a body having a central axis, a first end, a second end, an outer surface, and an inner through passage, wherein the outer surface at the second end is configured to be coupled to the production system;

a plurality of centering disks having a plurality of flexible flaps disposed circumferentially about and facing the central axis; and a plurality of annular spacers;

wherein each centering disk is alternatively stacked on each annular spacer;

wherein the flaps move axially up and down in response to a component of the string of components passing therethrough;

wherein the flaps maintain contact with the component of the string of components as the component passes therethrough.

14. A variable guide and protection bushing assembly for guiding a string of components to a cable hanger sealing surface disposed in a well production system, the well production system having an intervention member installed thereon, the assembly mountable to the well production system and comprising:

a body having a central axis, a first end, a second end, an outer surface, and an inner through passage, wherein the outer surface at the second end is configured to be coupled to the production system;

a protective sleeve having a diameter and disposed in and coaxial with the production system;

a biasing member coupled to the protective sleeve;

wherein the protective sleeve is configured to cover the cable hanger sealing surface when the protective sleeve and the biasing member are in an unactuated state, and expose the cable hanger sealing surface when the protective sleeve and the biasing member are in an actuated state;

wherein the protective sleeve and the biasing member are actuated by axial movement of a cable hanger having a diameter larger than the diameter of the protective sleeve;

wherein the biasing member is configured to compress until the cable hanger is aligned with and engaging the cable hanger sealing surface.

15. A variable guide and protection bushing assembly for guiding a string of components to a cable hanger sealing surface disposed in a well production system, the well production system having an intervention member installed thereon, the assembly mountable to the well production system and comprising:

a body having a central axis, a first end, a second end, an outer surface, and an inner through passage, wherein the outer surface at the second end is configured to be coupled to the production system;

a plurality of centering devices having a plurality of fins uniformly circumferentially and angularly spaced about the central axis;

wherein each fin of the plurality of fins is configured to at least one of bend and flex radially outward in response to a component of the string of components passing through the corresponding centering device; and wherein the fins maintain contact with the component of the string of components as the component passes therethrough.

16. A variable guide and protection bushing assembly for guiding a string of components to a cable hanger sealing surface disposed in a subsea tree having a blowout preventer with a lower riser package installed thereon, the assembly comprising:

a body mountable in the subsea tree, the body having a central axis, a first end, a second end, an outer surface, and an inner through passage;

wherein the outer surface at the first end is configured to be coupled to the lower riser package, and the outer surface at the second end is configured to be coupled to the subsea tree;

a cylindrical bore disposed in and coaxial with the inner through passage, the cylindrical bore forming a cylindrical surface larger in diameter than a diameter of the inner through passage; and a hydraulic connection between a hydraulically actuatable support element disposed in the cylindrical bore and an annular bore extending through the subsea tree, the lower riser package, and the blowout preventer.

17. The variable guide and protection bushing assembly of claim 16, wherein the cylindrical bore is a cylindrical cutout disposed in and coaxial with the inner through passage, the cutout having an upper shoulder and a lower shoulder;

wherein the actuatable support element is a plurality of rams disposed circumferentially about the central axis, each ram being in fluid communication with the annular bore and coupled to at least one biasing member, and the biasing member being coupled to the cylindrical surface;

wherein the at least one biasing member is biased in a retracted position toward the cylindrical surface; and wherein the plurality of rams is configured to move radially inward toward the central axis in response to a hydraulic force supplied from the annular bore, and move radially outward upon removal of the hydraulic force and in response to a force from the at least one biasing member.

18. The variable guide and protection bushing assembly of claim 16, wherein the cylindrical bore is an annular cavity disposed in and coaxial with the body, the annular cavity having an upper end and a lower end;

wherein the actuatable support element is a piston disposed in the annular cavity, the piston configured to be in fluid communication with the annular bore and coupled to a biasing member, and the biasing member being coupled to the upper end; and wherein the variable guide and protection bushing assembly further comprises a plurality of protective elements extending from the piston and into the subsea tree.

19. The variable guide and protection bushing assembly of claim 16, wherein the cylindrical bore is a cylindrical cutout having an upper shoulder and a lower shoulder;

wherein the actuatable support element is a plurality of bladders disposed circumferentially about the central axis;

wherein the plurality of bladders is in fluid communication with the annular bore;

wherein the plurality of bladders expand in response to a hydraulic force supplied from the annular bore, and deflate in response to a removal of the hydraulic force.

20. A method of guiding a string of components to a cable hanger sealing surface disposed in a well production system, the method comprising:

installing a variable guide and protection bushing assembly in the production system, the assembly including:

a body having a central axis, a first end, a second end, an outer surface, and an inner through passage;

a cylindrical cutout disposed in and coaxial with the inner through passage and forming a cylindrical surface having a larger diameter than a diameter of the inner through passage; and a variable centralizer component disposed in and coaxial with the cylindrical cutout and moveable radially inward and outward in response to a component of the string of components passing through the cylindrical cutout;

coupling an intervention member with the outer surface at the first end;

coupling the production system with the outer surface at the second end;

passing components of the string into the inner through passage; and centralizing the components of the string through the inner through passage to the cable hanger sealing surface via the variable centralizer component.

* * * * *